US008256805B2

(12) United States Patent
Ishiguro

(10) Patent No.: US 8,256,805 B2
(45) Date of Patent: Sep. 4, 2012

(54) VEHICLE DOOR LOCK DEVICE

(75) Inventor: Katsuyuki Ishiguro, Yamanashi (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 1114 days.

(21) Appl. No.: 12/140,758

(22) Filed: Jun. 17, 2008

(65) Prior Publication Data

US 2009/0025999 A1 Jan. 29, 2009

(30) Foreign Application Priority Data

Jul. 23, 2007 (JP) ..... 2007-190980

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS

| | | | | |
|---|---|---|---|---|
| 3,848,910 | A * | 11/1974 | Wilfert et al. | 292/216 |
| 5,092,638 | A * | 3/1992 | Mizuki | 292/216 |
| 5,718,465 | A * | 2/1998 | Dowling et al. | 292/216 |
| 5,762,383 | A * | 6/1998 | Gomi | 292/216 |
| 6,007,118 | A | 12/1999 | Arabia, Jr. et al. | |
| 6,010,165 | A | 1/2000 | Santarelli et al. | |
| 6,168,215 | B1 * | 1/2001 | Kodama et al. | 292/201 |
| 6,168,216 | B1 * | 1/2001 | Nakajima et al. | 292/201 |
| 6,343,817 | B1 * | 2/2002 | Watanabe | 292/216 |
| 6,382,686 | B1 * | 5/2002 | Ishigaki et al. | 292/201 |
| 6,406,073 | B1 * | 6/2002 | Watanabe | 292/216 |
| 6,634,682 | B2 * | 10/2003 | Fukunaga et al. | 292/216 |
| 7,293,806 | B2 * | 11/2007 | Umino | 292/216 |
| 7,380,845 | B2 * | 6/2008 | Suzumura et al. | 292/216 |
| 7,441,815 | B2 * | 10/2008 | Umino | 292/216 |
| 7,568,741 | B2 * | 8/2009 | Odahara | 292/216 |
| 7,621,571 | B2 * | 11/2009 | Umino | 292/216 |
| 7,770,945 | B2 * | 8/2010 | Umino | 292/201 |
| 7,874,599 | B2 * | 1/2011 | Suzumura et al. | 292/216 |
| 2004/0262927 | A1 * | 12/2004 | Fukunaga et al. | 292/216 |
| 2005/0087994 | A1 * | 4/2005 | Umino | 292/216 |
| 2007/0075552 | A1 * | 4/2007 | Hayakawa et al. | 292/216 |

FOREIGN PATENT DOCUMENTS

| | | | |
|---|---|---|---|
| JP | 2000-303732 | A | 10/2000 |
| JP | 2001-020579 | A | 1/2001 |
| JP | 2001-271531 | A | 10/2001 |

* cited by examiner

*Primary Examiner* — Carlos Lugo
*Assistant Examiner* — Alyson M Merlino
(74) *Attorney, Agent, or Firm* — Foley & Lardner LLP

(57) ABSTRACT

A vehicle door lock device includes a latching mechanism, a locking mechanism, and a child-lock mechanism. The child-lock mechanism is arranged between the latching mechanism and an inside door handle, and switches between a transmitting state and a non-transmitting state. The child-lock mechanism in the transmitting state transmits to the latching mechanism a force regarding an attempt to open a door by using the inside door handle, while the child-lock mechanism in the non-transmitting state does not transmit the force to the latching mechanism. When the latching mechanism receives the force, an inside-door handle lever causes the locking mechanism to switch to an unlocked state from a locked state. When the child-lock mechanism is in the transmitting state and the locking mechanism is in the locked state, a link lever and a panic lever operate the inside-door handle lever without transmitting the force to the latching mechanism.

1 Claim, 20 Drawing Sheets

VEHICLE DOOR LOCK DEVICE

BACKGROUND OF THE INVENTION

1. Field of the Invention

The present invention relates to a vehicle door lock device.

2. Description of the Related Art

In recent years, a door lock actuator is used to switch a locking mechanism in a vehicle door lock device between a locked state and an unlocked state. In addition to the locking mechanism, a vehicle door lock device disclosed in Japanese Patent Application Laid-open No. 2001-20579 includes a child-lock mechanism for preventing a child from accidentally opening a door from inside the vehicle. The child-lock mechanism can be switched between a transmitting state and a non-transmitting state. The child-lock mechanism in the transmitting state transmits to a latching mechanism a signal regarding an attempt to open the door by using an inside door handle, while the child-lock mechanism in the non-transmitting state does not transmit the signal to the latching mechanism.

Meanwhile, in some of the conventional vehicle door lock devices, a key cylinder is not provided on the inside part of a door. As a result, the locking mechanism cannot be operated from inside the vehicle. Such a configuration enhances a security level of the vehicle against theft. That is, even if someone breaks a window of the vehicle, it becomes difficult to unlock the door from inside without the key cylinder.

However, in such a case, if the door lock actuator or a power supply system for the door lock actuator does not work properly due to a failure, it is difficult to unlock the locking mechanism if a key cylinder is not provided from inside the vehicle. Moreover, if the child-lock mechanism is switched to the non-transmitting state, then the latch of the door cannot be released. Thus, it is not possible to open the door from inside the vehicle when the door lock actuator does not work properly.

SUMMARY OF THE INVENTION

It is an object of the present invention to at least partially solve the problems in the conventional technology.

According to an aspect of the present invention, a door lock device for a door of a vehicle, including an outside door handle arranged on an outer side of the door and an inside door handle arranged on an inner side of the door, includes a latching mechanism that, when the door is in a closed position, latches the door in a latched state and restricts movement of the door to an open position, a locking mechanism that is arranged between the latching mechanism and the outside door handle, and switches between a locked state and an unlocked state, the locking mechanism in the unlocked state transmitting to the latching mechanism a first force regarding an attempt to open the door by using the outside door handle, the locking mechanism in the locked state not transmitting the first force to the latching mechanism, the latching mechanism releasing the door from the latched state upon receiving the first force and allowing movement of the door to the open position, a door lock actuator that causes the locking mechanism to switch between the locked state and the unlocked state, a child-lock mechanism that is arranged between the latching mechanism and the inside door handle, and switches between a transmitting state and a non-transmitting state, the child-lock mechanism in the transmitting state transmitting to the latching mechanism a second force regarding an attempt to open the door by using the inside door handle, the child-lock mechanism in the non-transmitting state not transmitting the second force to the latching mechanism, an inside-door handle lever that operates when the latching mechanism receives the second force and causes the locking mechanism to switch to the unlocked state from the locked state, and a double action mechanism that, when the child-lock mechanism is in the transmitting state and the locking mechanism is in the locked state, operates the inside-door handle lever without transmitting the second force to the latching mechanism.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these exemplary embodiments.

FIGS. 1 to 4 are schematic diagrams of a vehicle door lock device according to a first embodiment of the present invention. The vehicle door lock device includes a door-lock case 10. A latch case 21 is fixed to the door-lock case 10 and includes a latching mechanism 20 in its inside. The vehicle door lock device is configured to be installed in a front-hinged door D at the right backseat of a vehicle body B of a four-wheeled vehicle (see FIG. 5).

Figure 5:
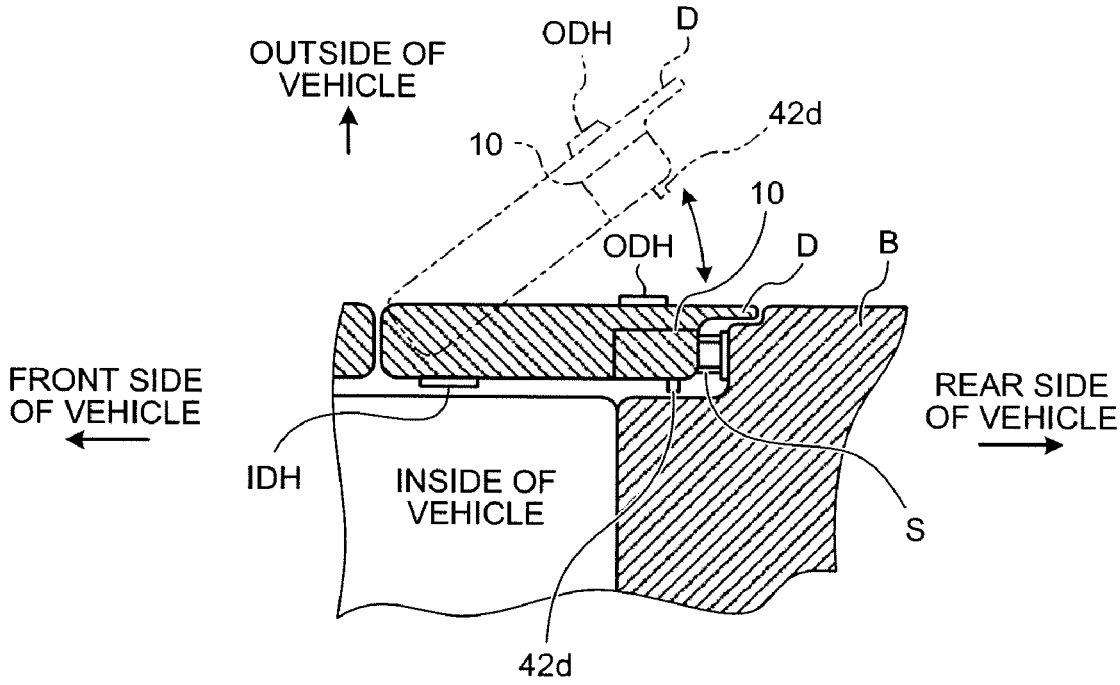
FIG. 5 is a plan view of a door of a vehicle in which the vehicle door lock device is configured to be installed.
Figure 6:
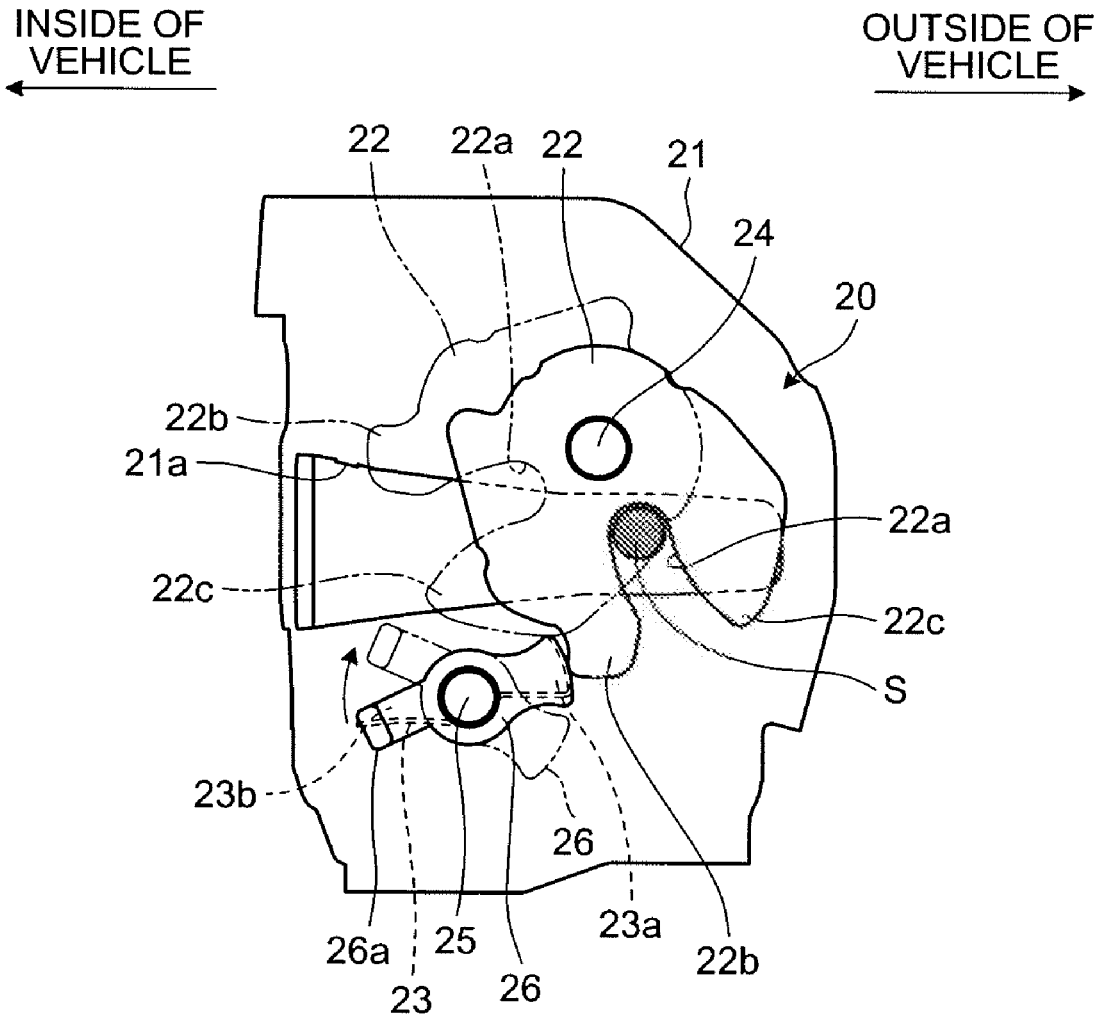
FIG. 6 is a schematic diagram of a latching mechanism arranged in the vehicle door lock device.

The latching mechanism 20 engages with a striker S arranged in the vehicle body B, and includes a latch 22 and a ratchet 23 (see FIGS. 5 and 6).

The latch 22 is rotatably arranged around a latch shaft 24 and at a position above a striker groove 21*a* arranged in the latch case 21. The latch shaft 24 is arranged substantially horizontal along the anteroposterior direction of the vehicle body B. The latch 22 includes a depression-for-engagement 22*a*, a hook portion 22*b*, and a locking portion 22*c*. The depression-for-engagement 22*a* is a depression from the outer circumference of the latch 22 in the direction of the latch shaft 24. The width of the depression-for-engagement 22*a* is large enough to accommodate therein the striker S. The hook portion 22*b* is a portion which locates inside the vehicle of the depression-for-engagement 22 when the latch 22 is positioned such that the depression-for-engagement 22*a* is open downwards. Meanwhile, if the latch 22 is rotated in counterclockwise direction to a maximum extent as shown by a full line in FIG. 6, the hook portion 22*b* rests after passing transversely across the striker groove 21*a*. On the other hand, if the latch 22 is rotated in clockwise direction to a maximum extent as shown by a dashed-two dotted line in FIG. 6, the hook portion 22*b* rests at a position where the striker groove 21*a* is in a released state. Regarding the locking portion 22*c*, the locking portion 22*c* is a portion which locates on the outside the vehicle of the depression-for-engagement 22*a* when the latch 22 is positioned such that the depression-for-engagement 22*a* is open downwards. When the latch 22 is rotated in clockwise direction to a maximum extent as shown by the dashed-two dotted line in FIG. 6, the locking portion 22*c* passes transversely across the striker groove 21*a* and rests at a slightly upward-inclined position in the outward direction with respect to the striker groove 21*a*. A latch spring (not shown) is arranged between the latch 22 and the latch case 21 such that the latch 22 is maintained biased in clockwise direction with reference to FIG. 6.

The ratchet 23 is rotatably arranged around a ratchet shaft 25 that lies substantially horizontal along the anteroposterior direction of the vehicle body B. The ratchet 23 is arranged beneath the striker groove 21*a* and on the vehicle-side with respect to the latch shaft 24. The ratchet 23 includes an engaging portion 23*a* and a working portion 23*b*. The engaging portion 23*a* extends outward in a radial direction from the ratchet shaft 25 toward the outside of the vehicle. When the ratchet 23 rotates around the ratchet shaft 25, the engaging portion 23*a* can detachably engage with the hook portion 22*b* and the locking portion 22*c* of the latch 22. The working portion 23*b* extends inward in a radial direction toward the inside of vehicle from the ratchet shaft 25. A ratchet lever 26 is attached to the ratchet 23 at an anterior position and rotates therewith around the ratchet shaft 25 in an integrated manner. The ratchet lever 26 includes a ratchet abutting portion 26*a* that extends in the same direction as that of the working portion 23*b*. A ratchet spring (not shown) is arranged between the ratchet 23 and the latch case 21 such that the ratchet 23 is maintained biased in counterclockwise direction with reference to FIG. 6.

When the door D is in an open position as shown by a dashed-two dotted line in FIG. 5, the latch 22 remains positioned in such a way that the striker groove 21*a* is in the released state as shown by the dashed-two dotted line in FIG. 6. When the door D is moved to a closed position as shown by a full line in FIG. 5, the striker S attached to the vehicle body B fits into the striker groove 21*a* of the latch case 21 and then abuts against the locking portion 22*c* of the latch 22 as shown in FIG. 6. As a result, the latch 22 rotates in counterclockwise direction by opposing the biasing force of the latch spring. Meanwhile, because of the biasing force of the ratchet spring, the engaging portion 23*a* comes in sliding contact with the outer circumference of the latch 22 and the ratchet 23 rotates around the ratchet shaft 25 depending on the shape of the outer circumference of the latch 22. When the door D is further moved to the closed position, the striker S gradually enters deeper into the striker groove 21*a*. The engaging portion 23*a* eventually reaches the position of the depression-for-engagement 22*a* and the hook portion 22*b* abuts against the engaging portion 23*a* as shown by the full line in FIG. 6. As a result, the clockwise rotation of the latch 22 is prevented by opposing the biasing restoring force of the latch spring. In this case, because the hook portion 22*b* rests at a position after passing transversely across the striker groove 21*a*, the striker S is prevented from disengaging towards the outward direction from the striker groove 21*a*. Thus, the door D is maintained at the closed position with respect to the door vehicle B. That is, the door D is maintained in a latched state.

When the ratchet abutting portion 26*a* is rotated upwards with reference to FIG. 6 from the latched state of the door D by opposing the biasing force of the ratchet spring, the hook portion 22*b* detaches from the engaging portion 23*a* and the latch 22 rotates in clockwise direction because of the biasing restoring force of the latch spring. As a result, the striker S disengages from the striker groove 21*a* and rests in the released state. Thus, it becomes possible to move the door D in the open position with respect to the vehicle body B.

Figure 1:
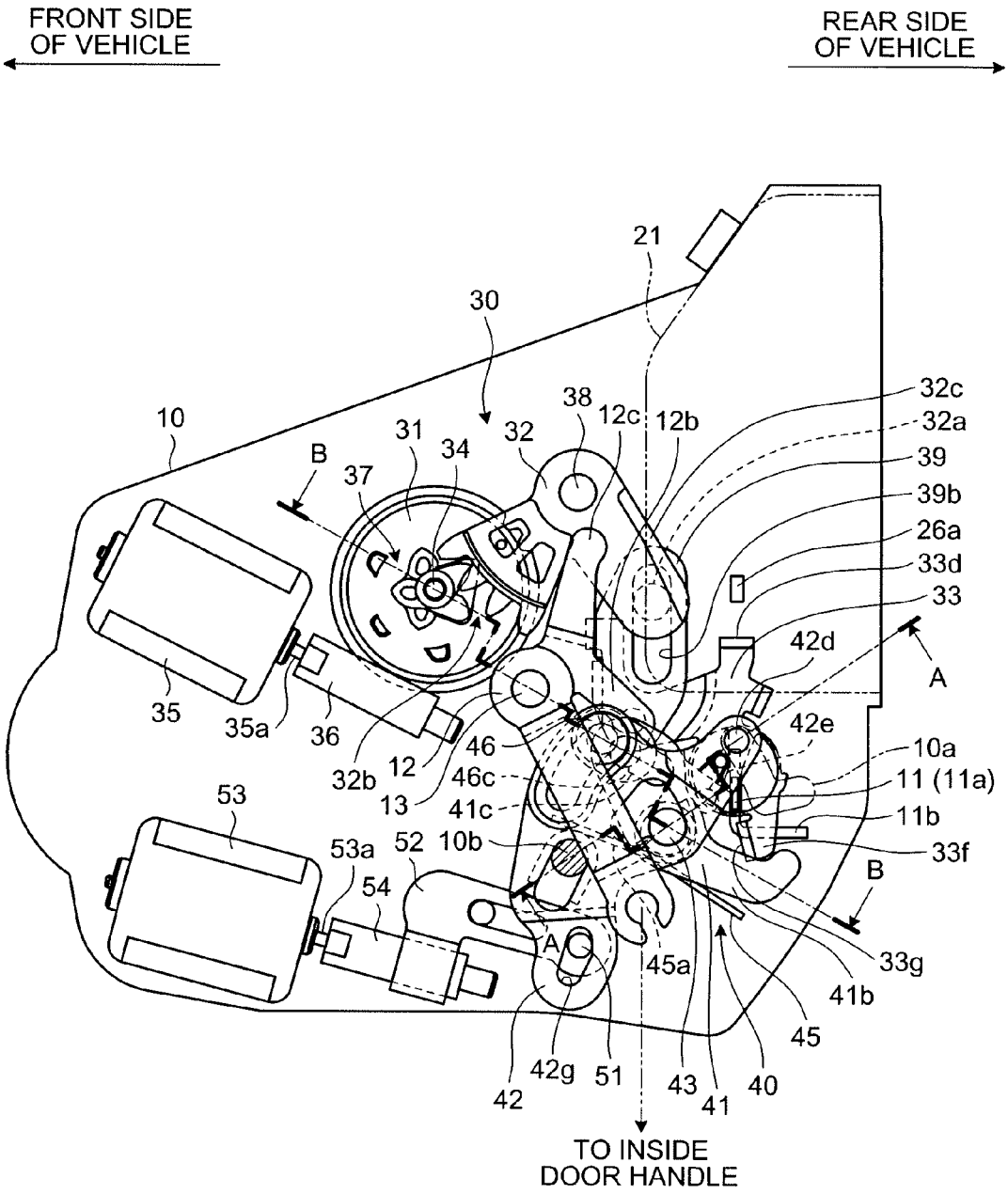
FIG. 1 is a schematic diagram of a vehicle door lock device according to a first embodiment of the present invention.

The door-lock case 10 includes an open lever 11, an inside handle lever 12, and a locking mechanism 30 as shown in FIG. 1.

The open lever 11 is rotatably arranged around an open lever shaft (not shown) that lies substantially horizontal along the anteroposterior direction of the vehicle body B. The open lever 11 includes an operating end 11*a* and a pressure receiving portion 11*b*. The operating end 11*a* is arranged beneath of the ratchet abutting portion 26*a* of the ratchet lever 26. The pressure receiving portion 11*b* extends beneath of the operating end 11*a* and bends towards the rear side of the vehicle body B. When an attempt is made to open the door D by using an outside door handle (ODH), which is fixed on the outer surface of the door D (see FIG. 5), the open lever 11 rotates via appropriate linkage (not shown) such that the operating end 11*a* and the pressure receiving portion 11*b* move upwards with reference to FIG. 1. An open lever spring (not shown) is arranged between the open lever 11 and the door-lock case 10 such that the operating end 11*a* and the pressure receiving portion 11*b* are maintained biased in downward direction with reference to FIG. 1.

Figure 7A:
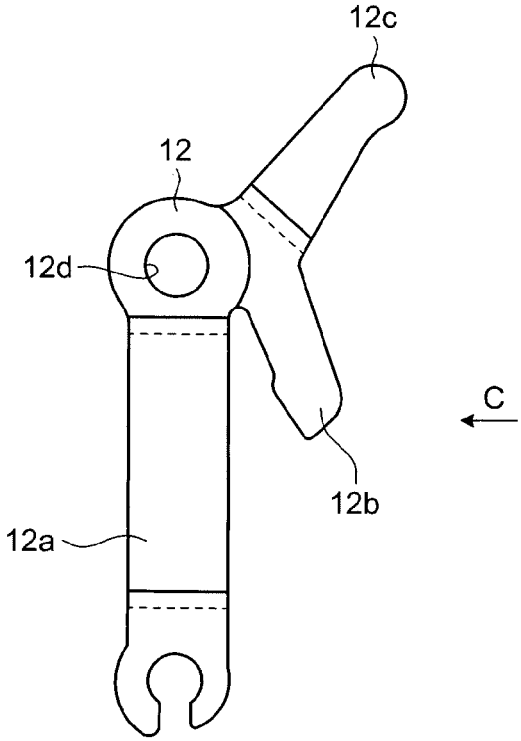
FIG. 7A is a schematic diagram of an inside handle lever arranged in the vehicle door lock device.
Figure 7B:
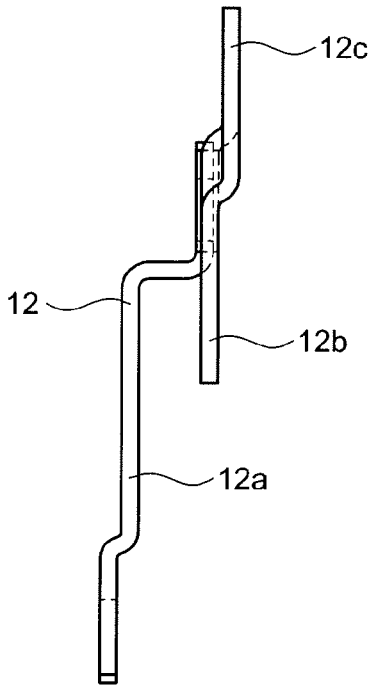
FIG. 7B is a view of the inside handle lever from an arrow C shown in FIG. 7A.

The inside handle lever 12 is pivotably arranged around an inside lever shaft 13 and at a position anterior to the open lever 11 on the vehicle body B. The inside lever shaft 13 lies substantially horizontal along the width direction of the vehicle body B. As shown in FIG. 7A, the inside handle lever 12 includes a working end 12*a*, an inside-handle lock linkage portion 12*b*, a sector lever abutting portion 12*c*, and an inside-lever shaft hole 12*d*. The working end 12*a* extends downwards from the inside lever shaft 13, bends towards the vehicle-side, and further extends downwards (see FIGS. 1 and 7B). The working end 12*a* is linked with an inside door handle (IDH) shown in FIG. 5 via an appropriate linkage (not shown). When an attempt is made to open the door D by using the inside door handle IDH, the inside handle lever 12 pivots in clockwise direction with reference to FIG. 1. The inside-handle lock linkage portion 12*b* and the sector lever abutting portion 12*c* extend from the inside lever shaft 13 towards the rear side of the vehicle body B and fork in two directions (see FIG. 1). The inside-handle lock linkage portion 12*b* forks downwards, while the sector lever abutting portion 12*c* forks upwards. The inside-lever shaft hole 12*d* has a diameter large enough for the inside lever shaft 13 to be inserted therethrough.

The locking mechanism 30 switches between an unlocked state and a locked state. During the unlocked state, the locking mechanism 30 transmits to the latching mechanism 20 force of the rotation of the open lever 11 due to an attempt to open the door D by using the outside door handle ODH. On the other hand, during the locked state, the locking mechanism 30 does not transmit the force to the latching mechanism 20. The locking mechanism 30 includes a worm wheel 31, a sector lever 32, and a link lever 33 (double action mechanism).

The worm wheel 31 is rotatably arranged around a wheel shaft 34 and at a position anterior to the inside handle lever 12. The wheel shaft 34 lies substantially horizontal along the width direction of the vehicle body B. The worm wheel 31 engages with a first worm 36 that is fixed to a first output shaft 35*a* of a first electric motor 35 (lock actuator). An intermittent gear wheel 37 is fixed to the coaxial core of the worm wheel 31. The intermittent gear wheel 37 forms a one-direction intermittent drive-line mechanism with an intermittent driven gear 32*b* of the sector lever 32. A neutrality spring 31*a* is arranged between the worm wheel 31 and the door-lock case 10 such that the worm wheel 31 is maintained in a predetermined neutral state.

The sector lever 32 is rotatably arranged around a sector lever shaft 38 and at a position posterior to the worm wheel 31. The sector lever shaft 38 lies substantially horizontal along the width direction of the vehicle body B. The sector lever 32 has a sector-shaped portion in the anterior direction, and includes a coupling pin 32*a*, the intermittent driven gear 32*b*, and an inside-handle-lever abutting portion 32*c*. The coupling pin 32*a* is a columnar protrusion at a surface of the sector lever 32 that faces in the outward direction and extends substantially horizontal along the width direction of the vehicle body B. The intermittent driven gear 32*b* is a toothed gear on the arc-like circumference of the sector lever 32 and engages with the intermittent gear wheel 37. The inside-handle-lever abutting portion 32*c* is an inward salient from the rear edge portion of the sector lever 32. When the inside handle lever 12 pivots in clockwise direction with reference to FIG. 1, the inside-handle-lever abutting portion 32*c* abuts against the sector lever abutting portion 12*c*.

The intermittent drive-line mechanism between the intermittent driven gear 32*b* and the intermittent gear wheel 37 arbitrarily rotates the worm wheel 31 such that the sector lever 32 can pivot in an arbitrary direction. Moreover, the intermittent drive-line mechanism is configured such that the sector lever 32 pivots without any power transmission from the intermittent driven gear 32*b* to the intermittent gear wheel 37 and without any rotation of the worm wheel 31.

The link lever 33 includes a link lever body 33*a* and a link lever hole 33*b*. The link lever hole 33*b* is arranged at the bottom end of the link lever body 33*a*. The operating end 11*a* is inserted through the link lever hole 33*b* such that the link lever 33 can move vertically along with the operating end 11*a* and the pressure receiving portion 11*b*, and pivot with respect to the operating end 11*a* around a shaft center in the width direction of the vehicle body B. The panic lever is provided with a panic lever abutting portion 33*c* and a ratchet driving portion 33*d*. The panic lever abutting portion 33*c* bends from the anterior end of the link lever body 33*a* towards the inside vehicle. The ratchet driving portion 33*d* is an engaging portion on the link lever body 33*a*. The ratchet driving portion 33*d* is arranged vertically above the link lever hole 33*b* such that it lies adjacent to and faces to the bottom end of the ratchet abutting portion 26*a*.

The link lever 33 includes a lock lever portion 33*f*. The lock lever portion 33*f* extends downwards from the link lever hole 33*b* and then bends towards the vehicle-inside, in case that the ratchet driving portion 33*d* is placed vertically upward of the link lever hole 33*b*. The lock lever portion 33*f* includes an operation abutting surface 33*g* on the front side of the vehicle. The operation abutting surface 33*g* is configured to slightly incline downward toward the front, in case that the ratchet driving portion 33*d* is placed vertically upward of the link lever hole 33*b*.

The link lever 33 is linked to a panic lever 39 (a double action mechanism). The panic lever 39 includes a panic lever shaft 39*a*. The panic lever shaft 39*a* extends from an end surface on the outside vehicle of the panic lever 39 along a substantially horizontal axis in the width direction of the vehicle body B. The panic lever shaft 39*a* is inserted through a hole (not shown) of the link lever 33 such that the panic lever 39 can pivot around the panic lever shaft 39*a*. The anterior end surface of the panic lever 39 abuts against the panic lever abutting portion 33*c*. The panic lever shaft 39*a* is provided with a linking slit 39*b*. The linking slit 39*b* is a slit formed along a vertical direction of the panic lever 39 to movably fit the coupling pin 32*a* of the sector lever 32 therein. A panic spring (not shown) is arranged between the link lever 33 and the panic lever 39 such that the anterior end surface of the panic lever 39 is maintained to abut against the panic lever abutting portion 33*c*.

Figure 4:
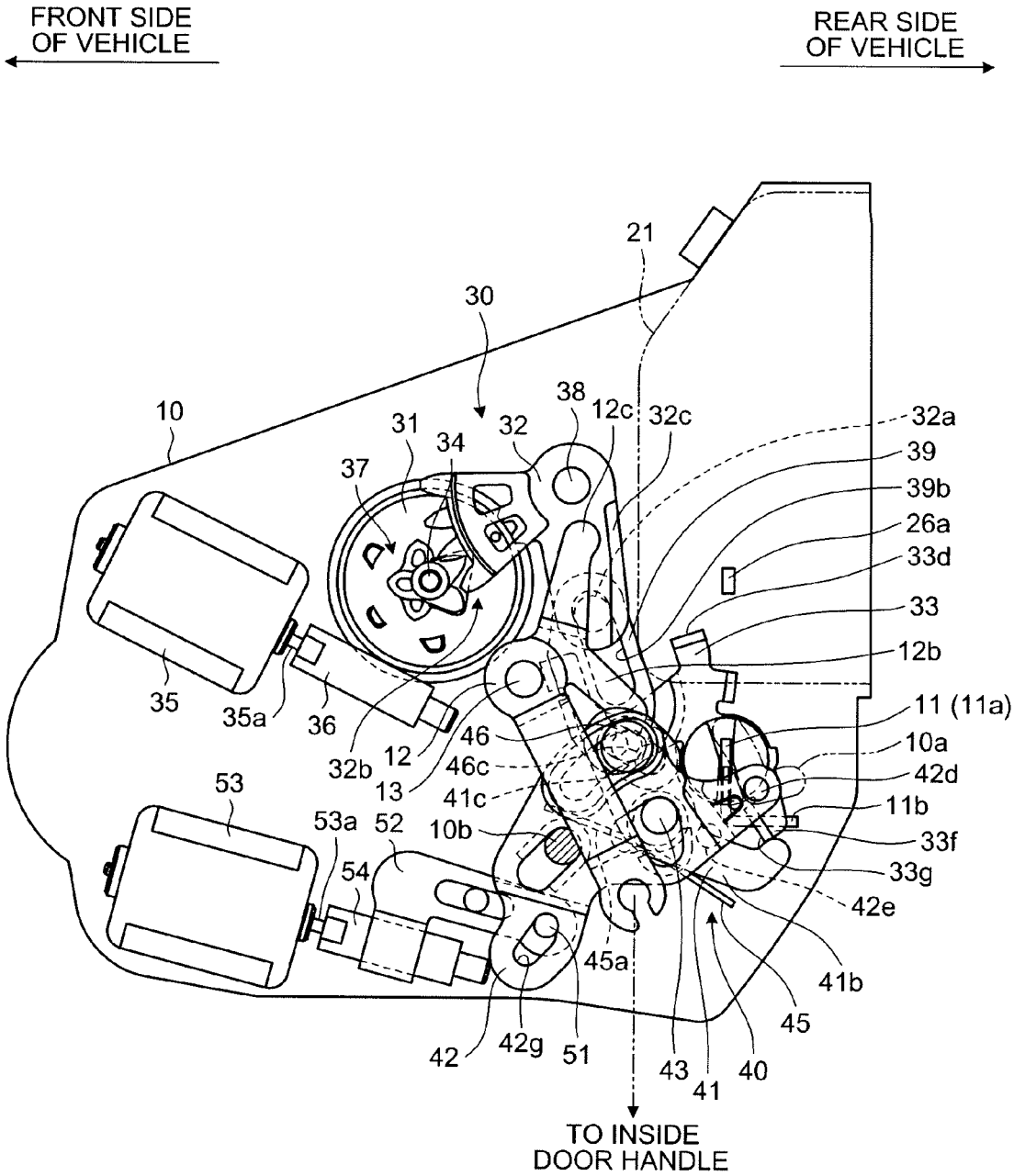
FIG. 4 is a schematic diagram of the vehicle door lock device in which the manually operated portion is released from the third position.

As shown in FIG. 4, the door lock device above includes a child-lock mechanism 40 inside the door-lock case 10. The child-lock mechanism 40 switches between a transmitting state and a non-transmitting state. During the transmitting state, the child-lock mechanism 40 transmits to the latching mechanism 20 a force caused by an attempt to open the door D by using the inside door handle IDH. On the other hand, during the non-transmitting state, the child-lock mechanism 40 does not transmit to the latching mechanism 20 the force caused by an attempt to open the door D by using the inside door handle IDH. The child-lock mechanism 40 includes a connect lever 41, a child-lock lever 42, and a child-lock pin 46.

Figure 8:
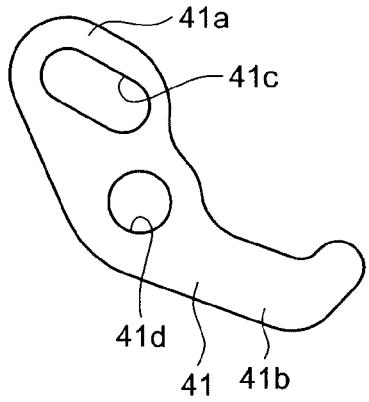
FIG. 8 is a schematic diagram of a connect lever arranged in the vehicle door lock device.

The connect lever 41 is pivotably arranged around a connect lever shaft 43, and lies between the inside handle lever 12 and the link lever 33. The connect lever shaft 43 lies substantially horizontal along the width direction of the vehicle body B. As shown in FIG. 8, the connect lever 41 includes an accommodating end 41*a*, a transmitting end 41*b*, and a connect-lever shaft hole 41*d*. The accommodating end 41*a* extends upwards from the connect lever shaft 43 and includes a pin accommodating slit 41*c* (see FIGS. 1 and 8). When the inside-handle lock linkage portion 12*b* pivots around the inside lever shaft 13, the anterior end of the inside-handle lock linkage portion 12*b* gets accommodated into the pin accommodating slit 41*c*, while the rear end thereof lies outside of the pivoting area of the pin accommodating slit 41*c*. The transmitting end 41*b* has a slight posterior declination from the connect lever shaft 43 and then a slight posterior inclination. The slightly inclined portion of the transmitting end 41*b* lies beneath the pressure receiving portion 11*b*. The connect-lever shaft hole 41*d* has a diameter large enough for the connect lever shaft 43 to be inserted therethrough.

Figure 9A:
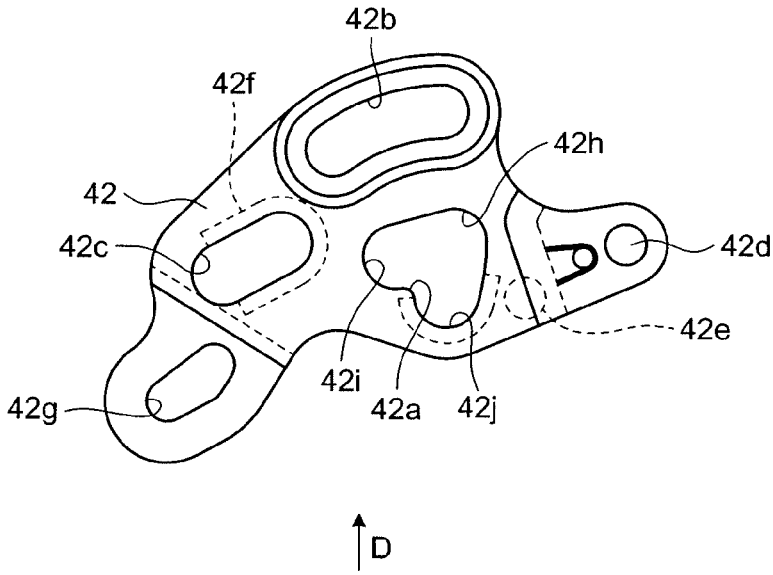
FIG. 9A is a schematic diagram of a child-lock lever arranged in the vehicle door lock device.

The child-lock lever 42 is pivotably arranged around a shaft center extending in the width direction of the vehicle body B such that the child-lock lever 42 overlaps the connect lever 41, and lies between the connect lever 41 and the door-lock case 10. The child-lock lever 42 pivots in the width direction in an arc-like manner and moves along the anteroposterior direction of the vehicle body B. As shown in FIG. 9A, the child-lock lever 42 includes a slide groove 42*a*, a child-lock pin slit 42*b*, a child-lock lever-shaft slit 42*c*, a manually operated portion 42*d*, a lock operating portion 42*e*, a restoring-spring abutting portion 42*f*, and a power child-lock slit 42*g*.

Figure 2:
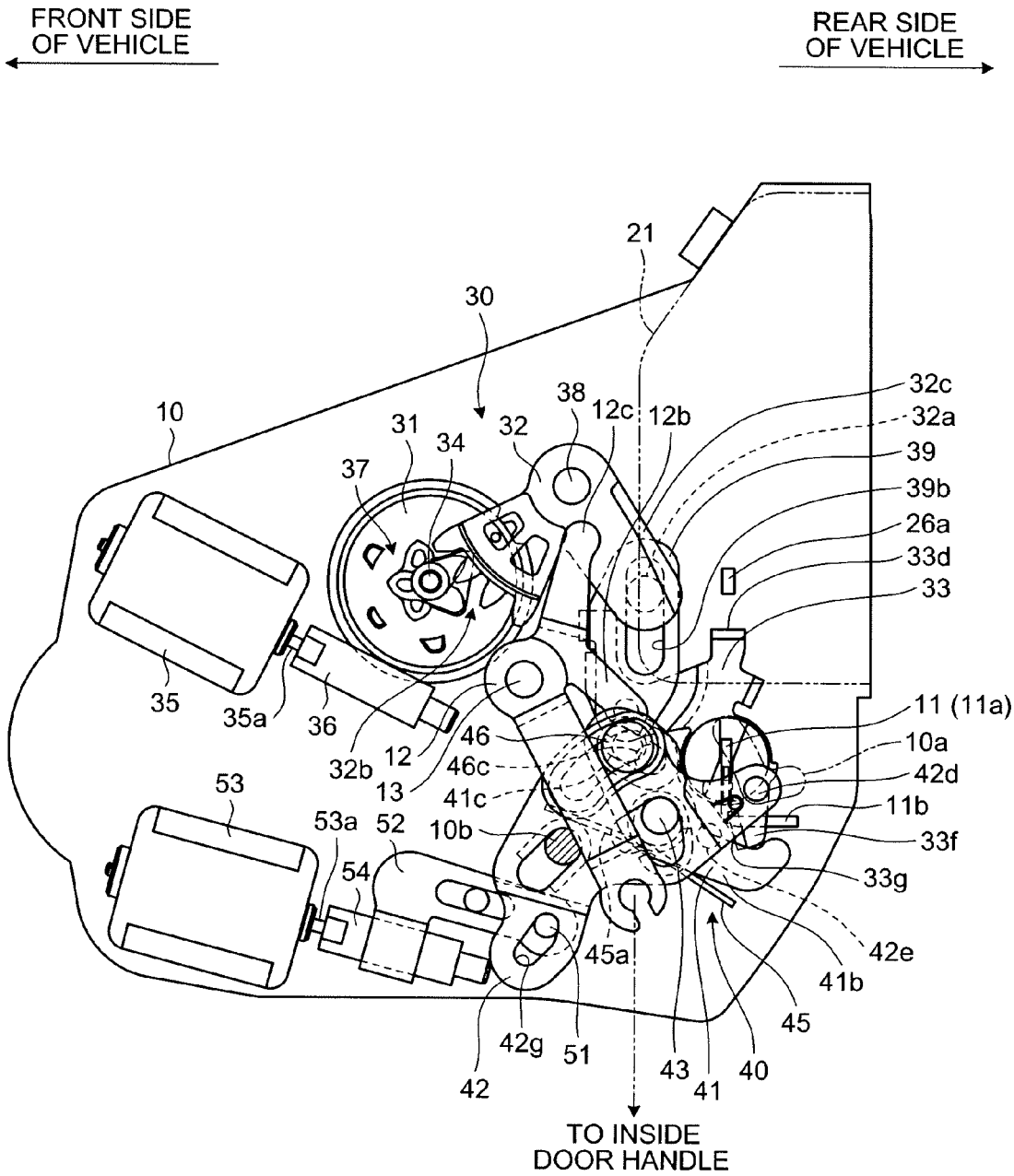
FIG. 2 is a schematic diagram of the vehicle door lock device when a child-lock mechanism is in a non-transmitting state.
Figure 3:
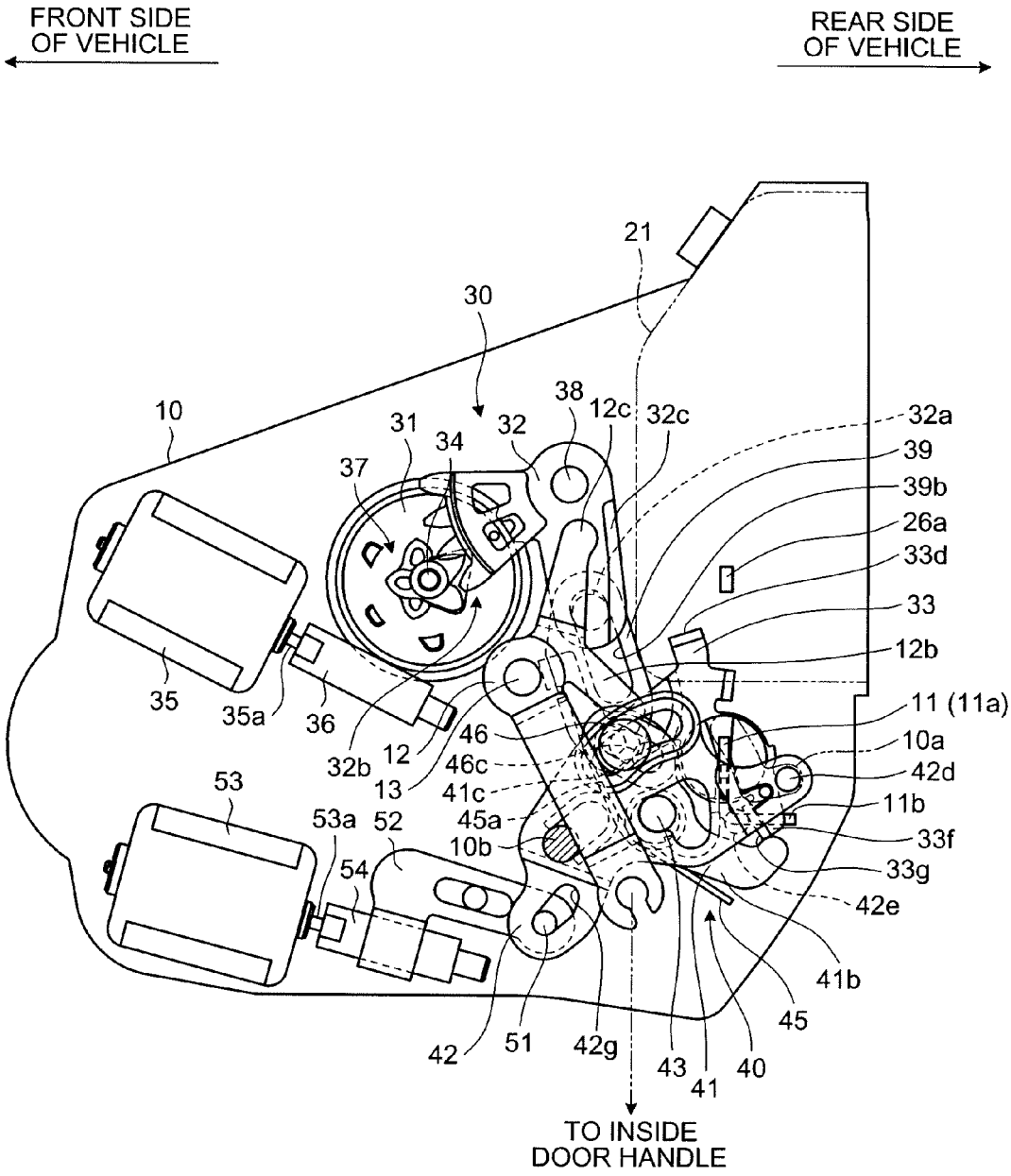
FIG. 3 is a schematic diagram of the vehicle door lock device when a manually operated portion in a child-lock lever is positioned at a third position.
Figure 16:
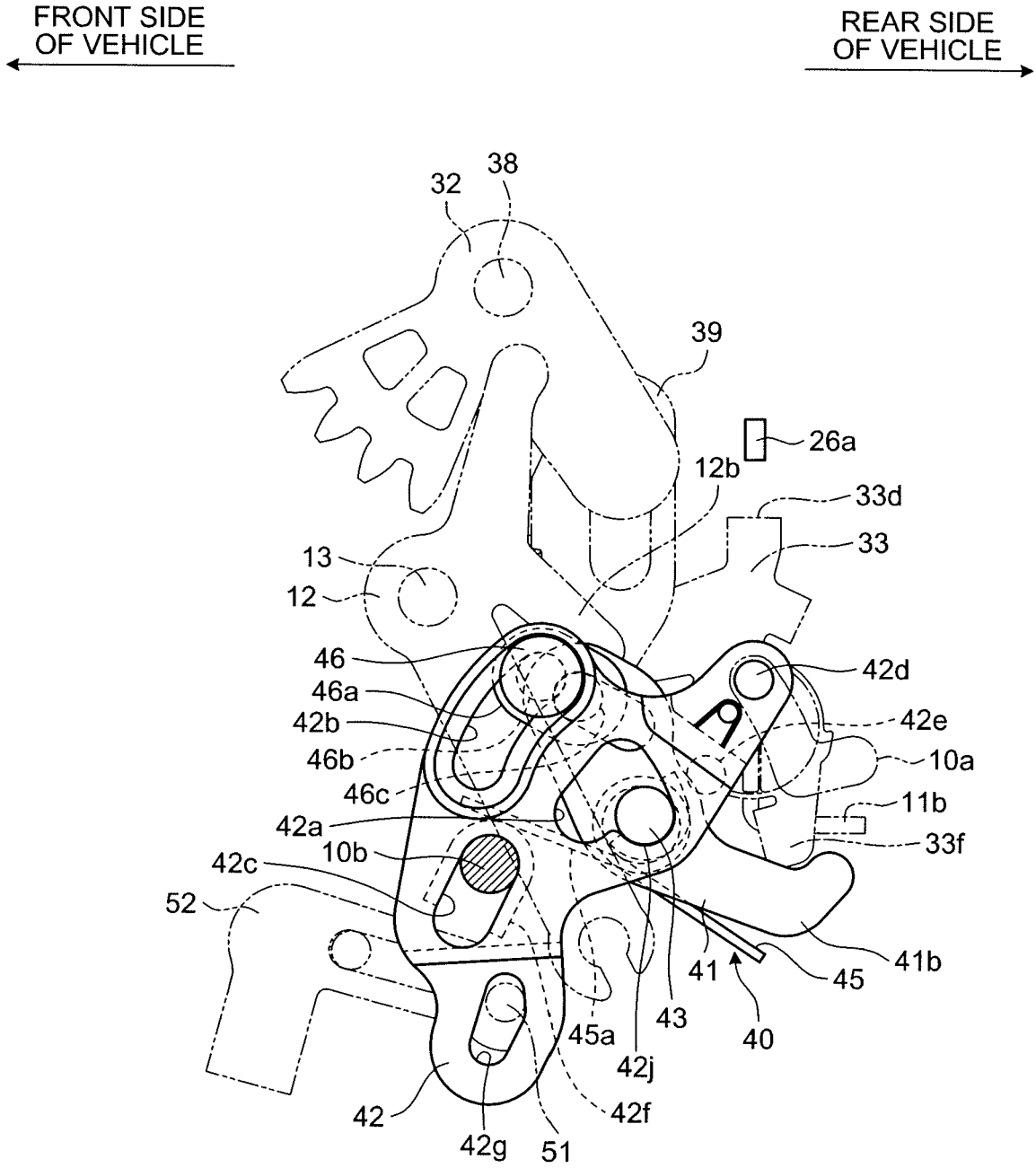
FIG. 16 is an enlarged view of main parts of the vehicle door lock device in FIG. 1.

The slide groove 42*a* is an inverted V-shaped groove through which the connect lever shaft 43 can be inserted (see FIG. 16). The slide groove 42*a* includes a child lock portion 42*h* in the top portion, an emergency lock portion 42*i* in the anterior portion, and an unlock portion 42*j* in the bottom portion as shown in FIG. 9A. After passing through the slide groove 42*a*, the connect lever shaft 43 is positioned alternatively at the child lock portion 42*h*, the emergency lock portion 42*i*, and the unlock portion 42*j* as shown in FIGS. 1, 2, and 3, respectively.

The child-lock pin slit 42*b* extends from the top portion of the child-lock lever 42 toward the anterior portion of the vehicle and along the longitudinal direction of the child-lock lever 42.

The child-lock lever-shaft slit 42*c* is arranged in an anterior portion side of the vehicle with respect to the connect lever shaft 43 such that a child-lock lever shaft 10*b* can be inserted from an interior side of the door-lock case 10 (see FIG. 16). The child-lock lever shaft 10*b* extends from the vehicle-side surface of the door-lock case 10 and lies substantially horizontal along the width direction of the vehicle body B. The child-lock lever-shaft slit 42*c* is configured to allow that the child-lock lever shaft 10*b* move along longitudinal direction of the child-lock lever-shaft slit 42*c*.

Figure 11A:
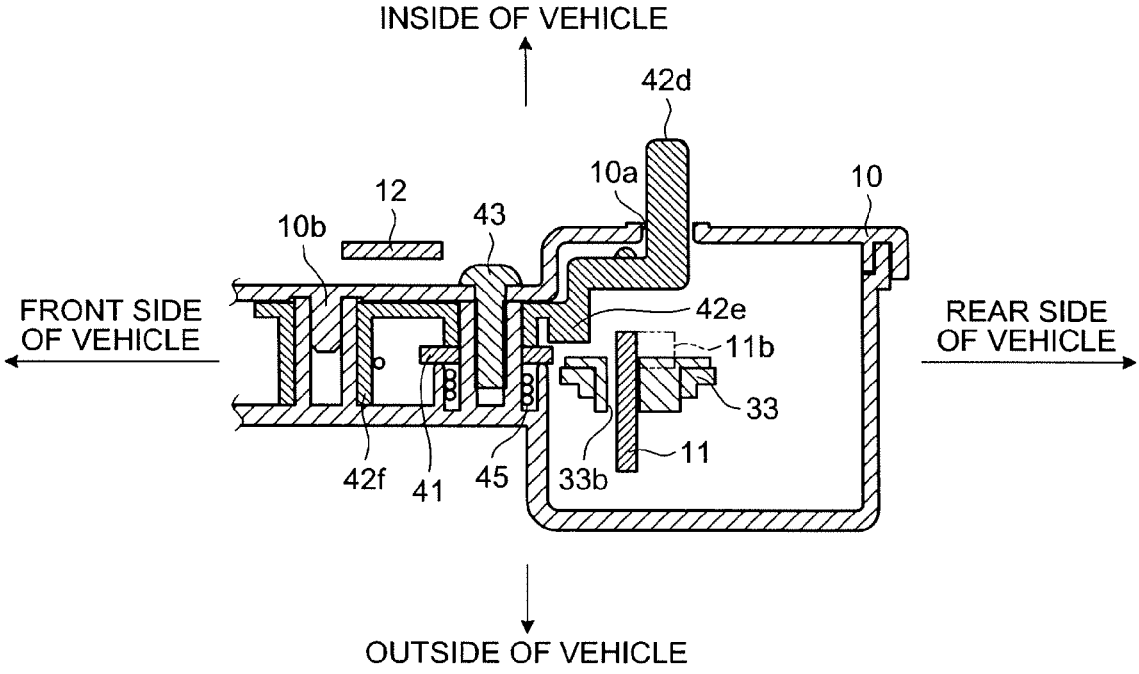
FIG. 11A is a cross-sectional diagram of the vehicle door lock device along the line A-A.

The manually operated portion 42*d* is a columnar portion extending from the interior side surface of the child-lock lever 42 and lies substantially horizontal along the width direction of the vehicle body B (see FIG. 11A). The manually operated portion 42*d* protrudes outside the vehicle body B through a lock-case hole 10*a* of the door-lock case 10 and an opening of a panel (not shown) of the door D. Due to such a configuration, it is possible to pivot the child-lock lever 42 in an arc-like manner around the shaft center in the width direction of the vehicle body B and move along the anteroposterior direction of the vehicle body B from outside of the door D. As shown in FIG. 5, the manually operated portion 42*d* is arranged at the inside surface of the door D in such a manner that, when the door D is in the closed position, the manually operated portion 42*d* remains in a blocked state. As shown in FIG. 1, the lock-case hole 10*a* is a substantially L-shaped opening that specifies the positions of the manually operated portion 42*d* in the child-lock lever 42. The position of the manually operated portion 42*d* above the lock-case hole 10*a* as shown in FIG. 1 is referred to as a first position. The manually operated portion 42*d* can pivot downwards around the shaft center in the width direction of the vehicle body B in an arc-like manner to a second position as shown in FIG. 2. The manually operated portion 42*d* can further move inside the lock-case hole 10*a* towards the rear side of the vehicle body B to a third position as shown in FIG. 3.

Figure 9B:
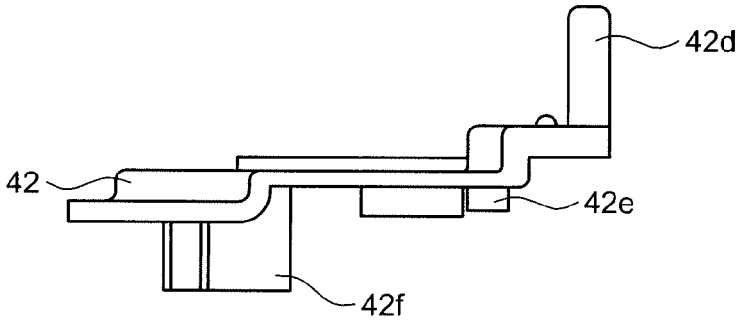
FIG. 9B is a view of the child-lock lever from an arrow D shown in FIG. 9A.

The lock operating portion 42*e* is a protrusion at the end portion on the vehicle posterior side of the child-lock lever 42 extending outward of the vehicle body B (see FIGS. 1 and 9B). When the manually operated portion 42*d* is positioned at either one of the first position and the second position, the lock operating portion 42*e* is distantly positioned from the operation abutting surface 33*g* of the lock lever 33*f* which is slightly anteverted toward the front of vehicle as shown in FIG. 1 and FIG. 2. On the other hand, when the manually operated portion 42*d* is positioned at the third position, the lock operating portion 42*e* is positioned such that the link lever 33 is rotated in counterclockwise direction via the operation abutting surface 33*g* and the locking mechanism 30 is switched to the locked state as shown in FIG. 3.

The restoring-spring abutting portion 42*f* is a salient at the end part of the child-lock lever shaft slit 42*c* in the outward direction of the vehicle body B (see FIG. 11A).

The power child-lock slit 42*g* is arranged at the bottom end of the child-lock lever 42.

Meanwhile, a restoring spring 45 is arranged between the child-lock lever 42 and the door-lock case 10 such that the child-lock lever 42 is maintained biased in counterclockwise direction around the connect lever shaft 43 (see FIG. 1). The restoring spring 45 is arranged via the connect lever shaft 43 at a position in the outward direction with respect to the connect lever 41. The restoring spring 45 includes a spring-action working portion 45*a*. Because of the biasing restoring force of the restoring spring 45, the spring-action working portion 45*a* biases the restoring-spring abutting portion 42*f* in counterclockwise direction around the connect lever shaft 43.

Figure 10A:
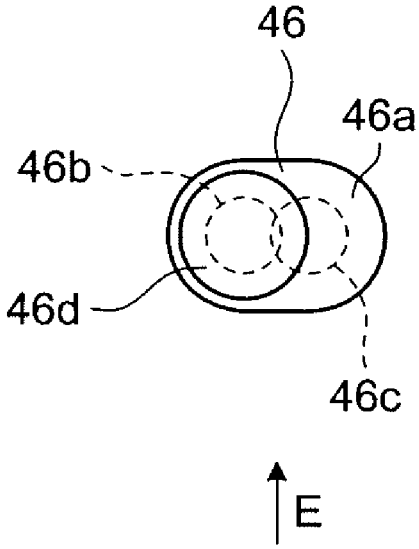
FIG. 10A is a schematic diagram of a child-lock pin arranged in the vehicle door lock device.
Figure 10B:
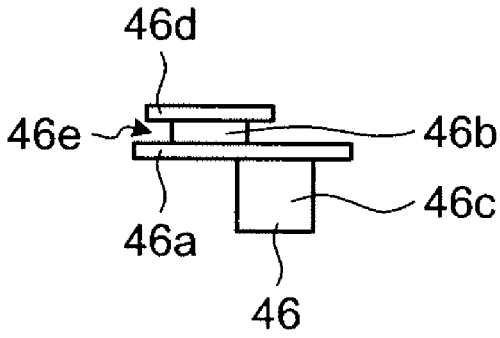
FIG. 10B is a view of the child-lock pin from an arrow E shown in FIG. 10A.
Figure 11B:
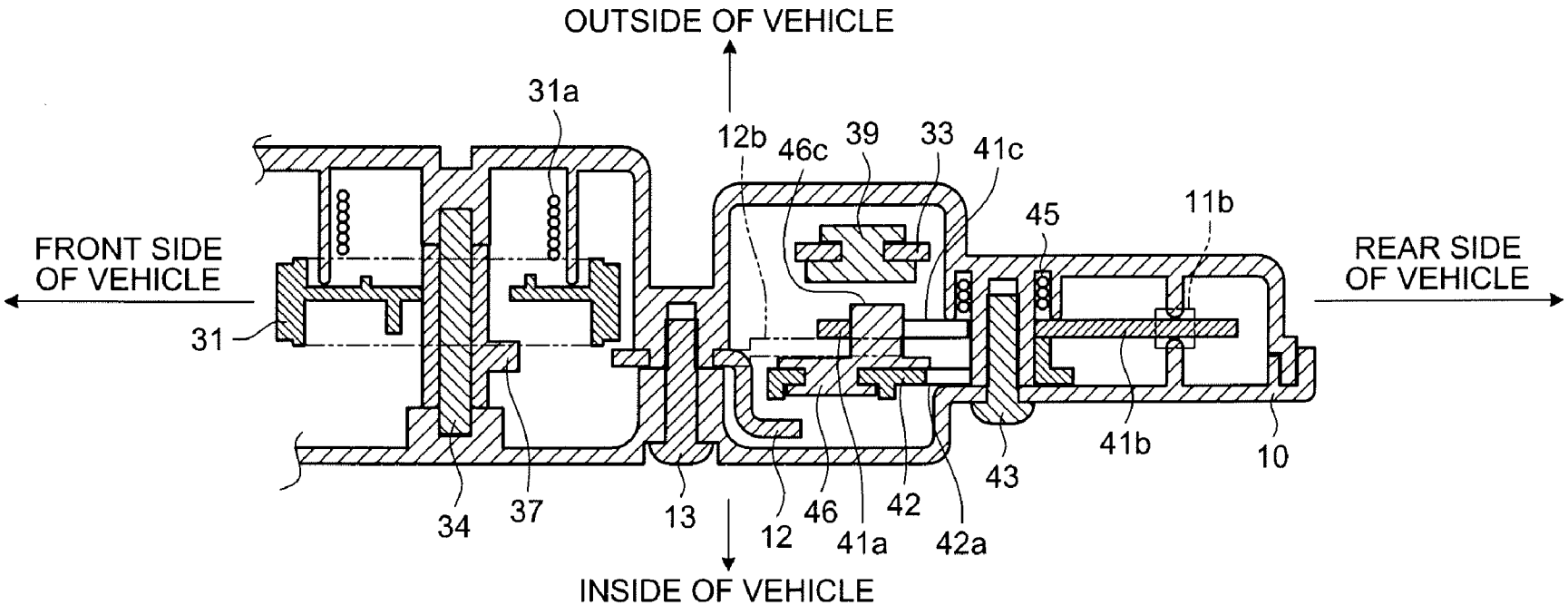
FIG. 11B is a cross-sectional diagram of the vehicle door lock device along the line B-B.

The child-lock pin 46 is fixed to the child-lock lever 42 (see FIG. 1). As shown in FIGS. 10A and 11B, the child-lock pin 46 includes a pin base portion 46*a*, a fixing pin 46*b*, and a transmitting pin 46*c*. The pin base portion 46*a* is a portion between the connect lever 41 and the child-lock lever 42. The fixing pin 46*b* is a columnar protrusion at the vehicle-side surface of the pin base portion 46*a* and extends substantially horizontal along the width direction of the vehicle body B. A stopper portion 46*d* lies at the protruded end of the fixing pin 46*b* and has a larger diameter than the fixing pin 46*b* (see FIGS. 10B and 11B). The pin base portion 46*a*, the fixing pin 46*b*, and the stopper portion 46*d* combinedly form a fixing groove 46*e*. The end part of the child-lock pin slit 42*b* fits into the fixing groove 46*e*. As a result, the child-lock pin 46 is movably fixed along the longitudinal direction of the child-lock pin slit 42*b* (see FIG. 10B). The transmitting pin 46*c* is a columnar protrusion at a surface of the pin base portion 46*a* that faces in the outward direction and extends substantially horizontal along the width direction of the vehicle body B. The transmitting pin 46*c* passes through the pin accommodating slit 41*c* and the protruded end thereof protrudes through the surface of the inside-handle lock linkage portion 12*b* facing in the outward direction (see FIG. 11B). When the manually operated portion 42*d* is positioned at the first position, the transmitting pin 46*c* is arranged within the pivoting area of the inside-handle lock linkage portion 12*b*. On the other hand, when the manually operated portion 42*d* is positioned at either of the second position and the third position, the transmitting pin 46*c* is arranged outside the pivoting area of the inside-handle lock linkage portion 12*b*.

A power child-lock pin 51 is inserted through the power child-lock slit 42*g*. The power child-lock pin 51 is a columnar protrusion at the vehicle-side surface of a power child-lock lever 52 and extends substantially horizontal along the width direction of the vehicle body B. When a second worm 54, which is fixed to a second output shaft 53*a* of a second electric motor 53, rotates, the power child-lock lever 52 and the power child-lock pin 51 move along the longitudinal direction of the second worm 54.

The locking mechanism 30 shown in FIG. 1 is in the unlocked state. During the unlocked state, the ratchet driving portion 33*d* is arranged vertically above the link lever hole 33*b* such that it adjacently faces to the bottom end of the ratchet abutting portion 26*a*. When an attempt is made to open the door D by using the outside door handle ODH and the link lever body 33*a* moves upwards due to the rotation of the open lever 11, the ratchet driving portion 33*d* abuts against the ratchet abutting portion 26*a* such that the ratchet abutting portion 26*a* is rotated upwards. As a result, the latching mechanism 20 is released from the latched state and the door D is opened with respect to the vehicle body B.

Figure 12:
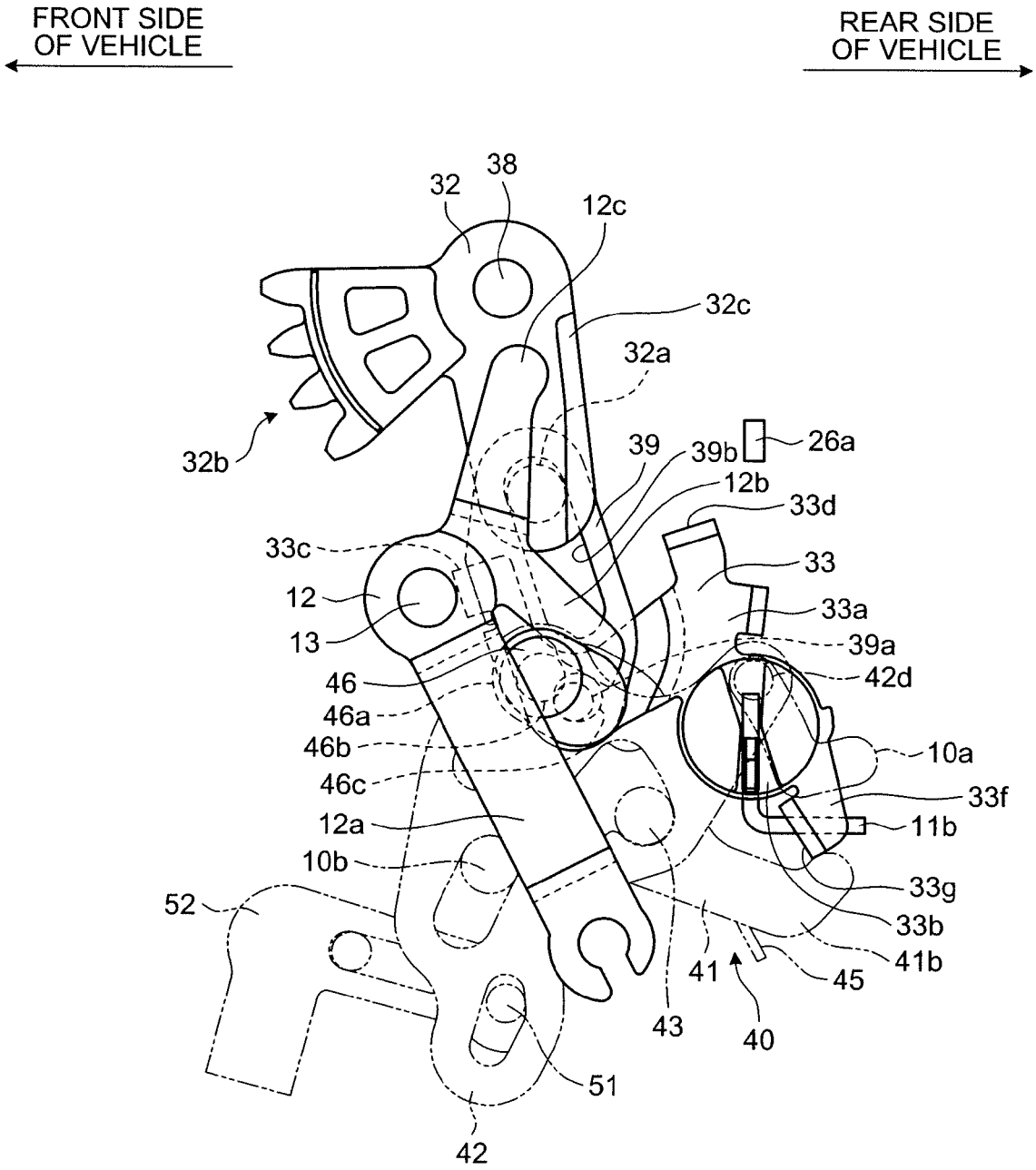
FIG. 12 is a schematic diagram for explaining a locking mechanism in a locked state.

During the unlocked state, when the worm wheel 31 is rotated in counterclockwise direction by the first electric motor 35, the sector lever 32 pivots in clockwise direction around the sector lever shaft 38. As a result, the coupling pin 32*a* and the link lever 33, which is linked via the panic lever 39, pivot in counterclockwise direction around the link lever hole 33*b*. The locking mechanism 30 thus switches to the locked state as shown in FIG. 12.

During the locked state, the ratchet driving portion 33*d* moves away from the position adjacent to the bottom end of the ratchet abutting portion 26*a*. Thus, even if an attempt is made to open the door D by using the outside door handle ODH and the link lever body 33*a* moves upwards due to the rotation of the open lever 11, the ratchet driving portion 33*d* does not abut against the ratchet abutting portion 26*a*. Thus, as long as the latching mechanism 20 is in the locked state, the door D is maintained at the closed position with respect to the door vehicle B.

Figure 13:
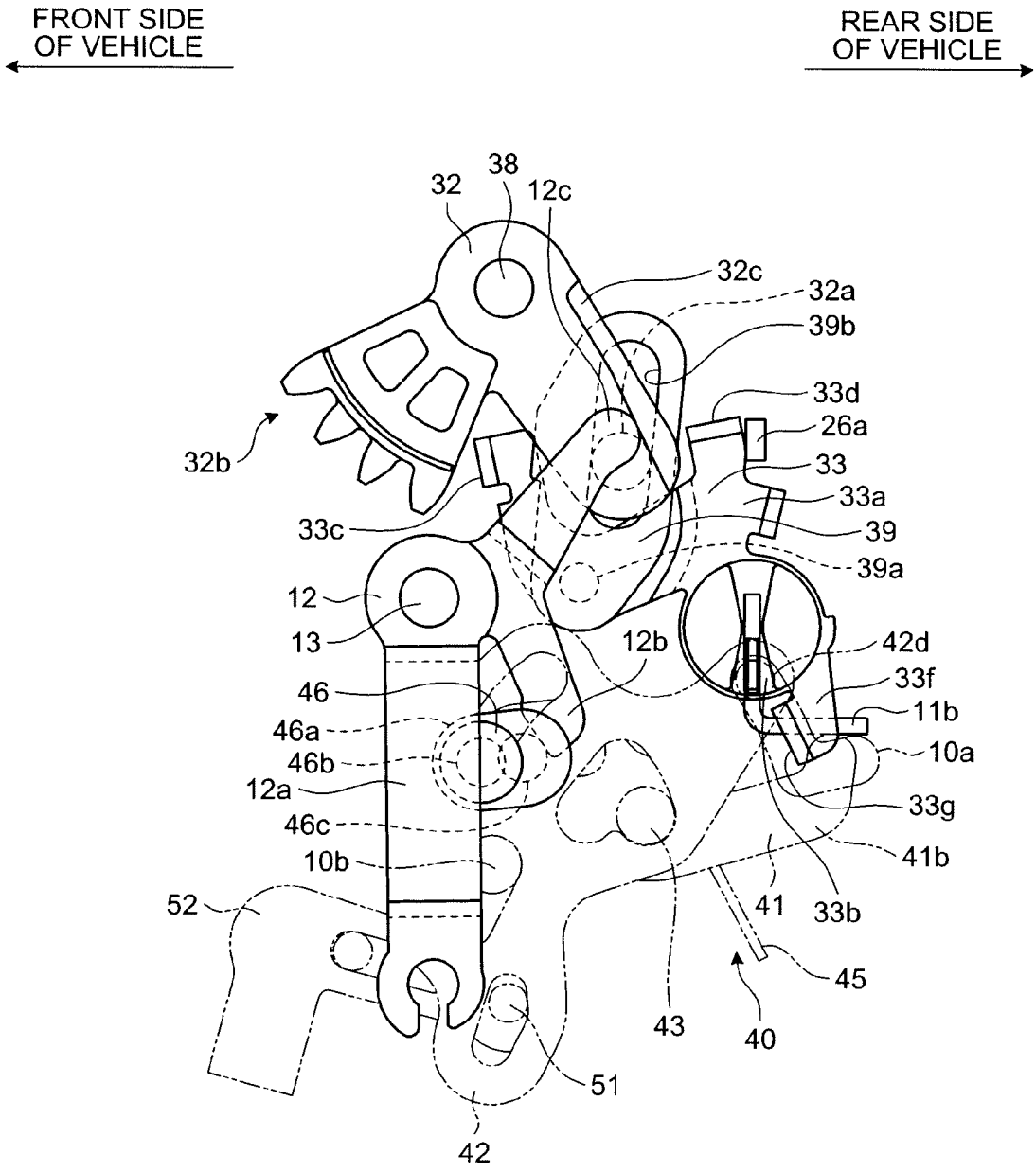
FIG. 13 is a schematic diagram for explaining a case in which the door is opened by using an inside door handle when the lock mechanism is in the locked state.

Meanwhile, during the locked state, the transmitting pin 46*c* is arranged within the pivoting area of the inside-handle lock linkage portion 12*b*. When an attempt is made to open the door D by using the inside door handle IDH, the inside-handle lock linkage portion 12*b* moves the transmitting pin 46*c* downwards, while the sector lever abutting portion 12*c* moves the inside-handle-lever abutting portion 32*c* towards the rear side of the vehicle body B. Consequently, the connect lever 41, through which the transmitting pin 46*c* is inserted, pivots in counterclockwise direction with reference to FIG. 12 such that the transmitting end 41*b* moves upwards. As a result, the link lever 33 also moves upwards via the pressure receiving portion 11*b*. When the inside-handle-lever abutting portion 32*c* moves towards the rear side of the vehicle body B, the sector lever 32 pivots in counterclockwise direction with reference to FIG. 12 and the coupling pin 32*a* moves towards the rear side of the vehicle body B. Thus, the panic lever 39 pivots in clockwise direction. In that case, because the ratchet driving portion 33*d* abuts against the anterior side of the ratchet abutting portion 26*a* as shown in FIG. 13, the panic lever 39 is detached from the panic lever abutting portion 33*c* by opposing the biasing restoring force of the panic spring. The panic lever 39 then pivots in clockwise direction with reference to FIG. 12.

Figure 14:
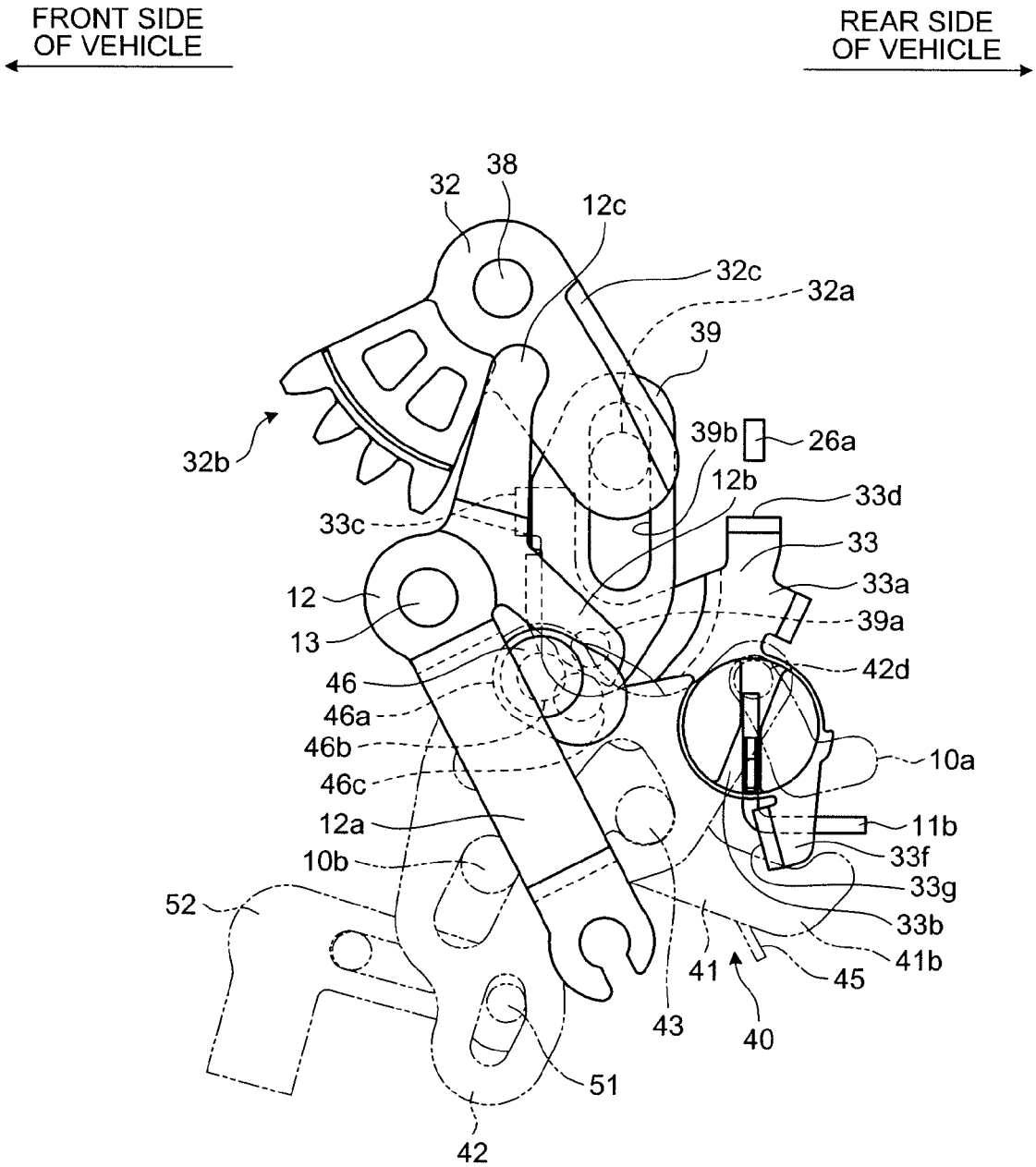
FIG. 14 is a schematic diagram for explaining a case in which the inside door handle is released.
Figure 15:
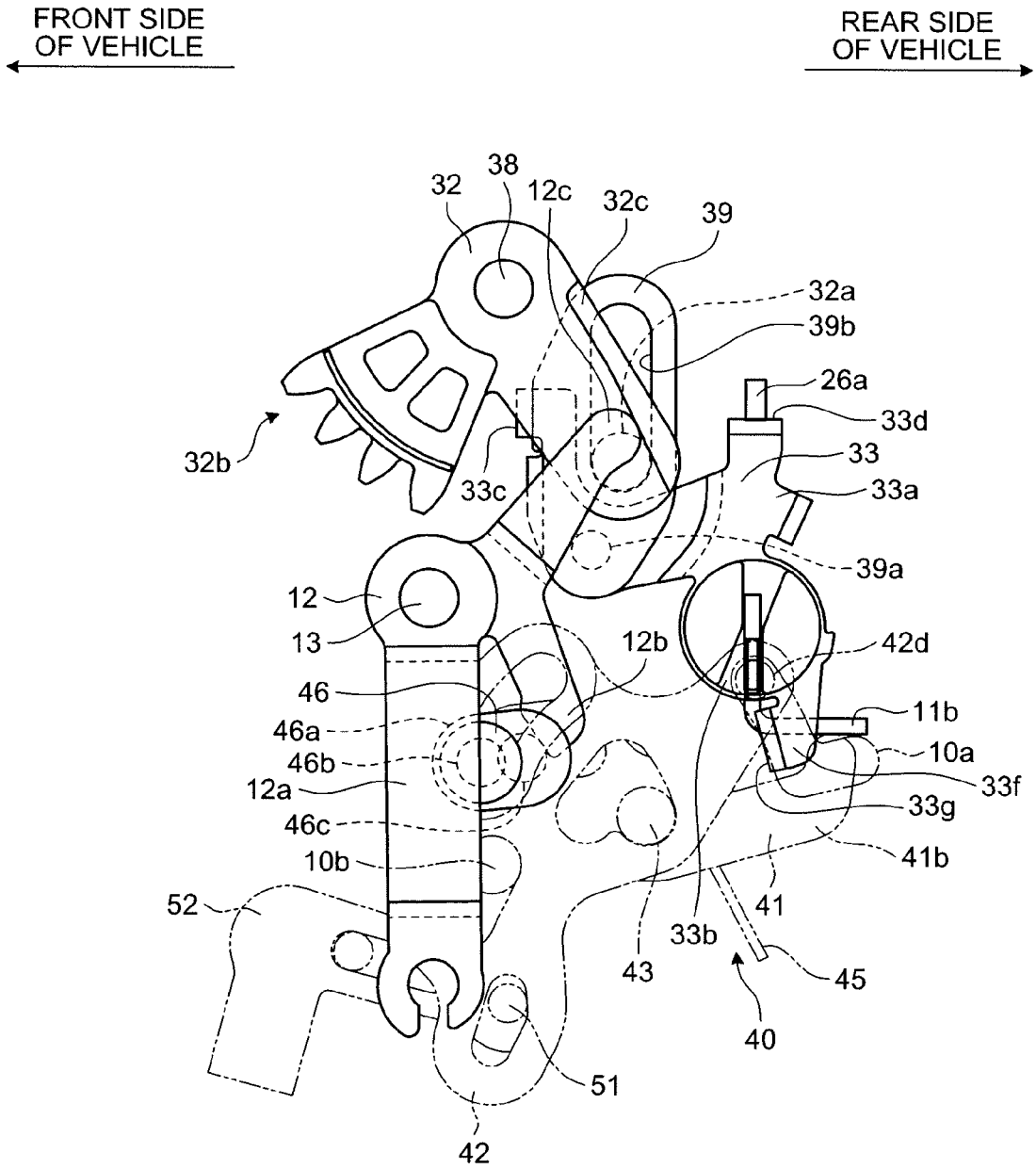
FIG. 15 is a schematic diagram for explaining a case in which the door is opened by using released inside door handle.

When the inside door handle IDH is released, the link lever 33 moves such that the panic lever abutting portion 33*c* re-abuts against the anterior surface of the panic lever 39 due to the biasing restoring force of the panic spring. Moreover, the operating end 11*a* and the pressure receiving portion 11*b* move downward due to the biasing restoring force of the open lever spring. As a result, the transmitting end 41*b* moves downward via the pressure receiving portion 11*b* and the transmitting pin 46*c* is rearranged within the pivoting area of the inside-handle lock linkage portion 12*b*. When the panic lever abutting portion 33*c* re-abuts against the anterior surface of the panic lever 39, the ratchet driving portion 33*d* is arranged vertically above the link lever hole 33*b* such that it lies adjacent to the bottom end of the ratchet abutting portion 26*a*. That is, the locking mechanism 30 switches to the unlocked state. During the unlocked state, when an attempt is made to open the door D by using the inside door handle IDH, the inside-handle lock linkage portion 12*b* moves the transmitting pin 46*c* downwards. Consequently, the connect lever 41, through which the transmitting pin 46*c* is inserted, pivots in counterclockwise direction with reference to FIG. 14 such that the transmitting end 41*b* moves upwards. The link lever 33 also moves upwards via the pressure receiving portion 11*b*. As a result, the link lever 33 abuts against the ratchet abutting portion 26*a* as shown in FIG. 15 and the latching mechanism 20 is released from the latched state. Because of such double action mechanism, the door D can be opened by using the inside door handle IDH.

During the locked state shown in FIG. 12, when the worm wheel 31 is rotated in clockwise direction by the first electric motor 35, the sector lever 32 pivots in counterclockwise direction around the sector lever shaft 38. As a result, the coupling pin 32*a* and the link lever 33, which is linked via the panic lever 39, pivot in clockwise direction around the link lever hole 33*b*. The locking mechanism 30 thus re-switches to the unlocked state as shown in FIG. 1.

Meanwhile, the child-lock mechanism 40 shown in FIGS. 1 and 16 is in the transmitting state. During the transmitting state, the transmitting pin 46*c* is arranged within the pivoting area of the inside-handle lock linkage portion 12*b*. When an attempt is made to open the door D by using the inside door handle IDH, the inside-handle lock linkage portion 12*b* moves the transmitting pin 46*c* downwards. Consequently, the connect lever 41, through which the transmitting pin 46*c* is inserted, pivots in counterclockwise direction with reference to FIGS. 1 and 16 such that the transmitting end 41*b* moves upwards. The link lever 33 also moves upwards via the pressure receiving portion 11*b*. As a result, if the locking mechanism 30 is in the unlocked status, the link lever 33 abuts against the ratchet abutting portion 26*a* such that the latching mechanism 20 is released from the latched state. Thus, the door D can be opened by using the inside door handle IDH.

Figure 17:
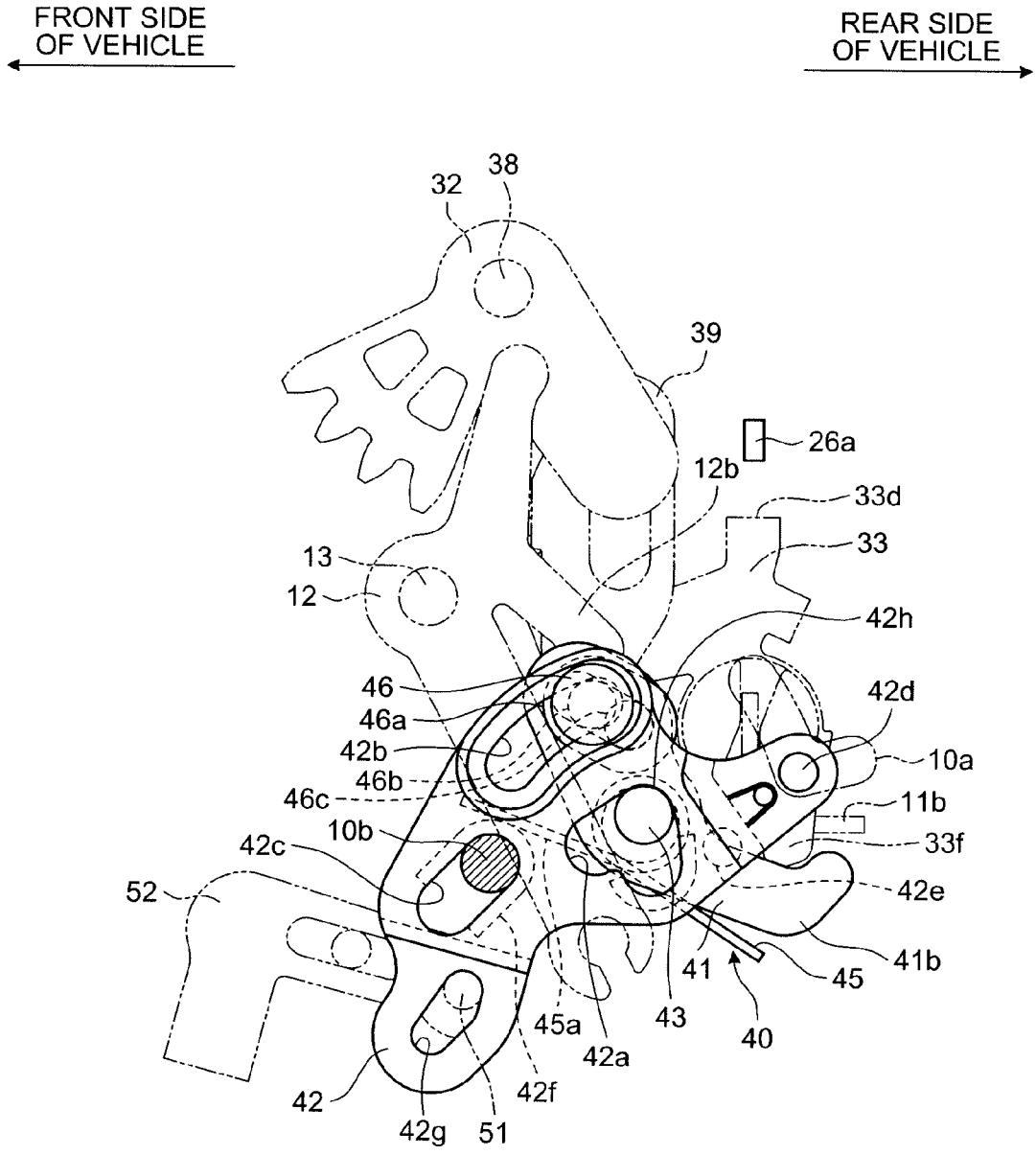
FIG. 17 is an enlarged view of main parts of the vehicle door lock device in FIG. 2.

When the manually operated portion 42*d* is moved from the first position as shown in FIGS. 1 and 16 to the second position as shown in FIGS. 2 and 17 in an arc-like manner around the shaft center in the width direction of the vehicle body B, the child-lock lever 42 pivots around the child-lock lever shaft 10*b* in clockwise direction with reference to FIGS. 1 and 16 such that the connect lever shaft 43 is positioned at the child lock portion 42*h*. That is, the child-lock mechanism 40 switches to the non-transmitting state. During the non-transmitting state, the transmitting pin 46*c* is arranged outside the pivoting area of the inside-handle lock linkage portion 12*b*. Thus, even if an attempt is made to open the door D by using the inside door handle IDH, the transmitting pin 46*c* does not abut against the inside-handle lock linkage portion 12*b* and the connect lever 41 does not pivot. As a result, the door D cannot be opened.

Figure 18:
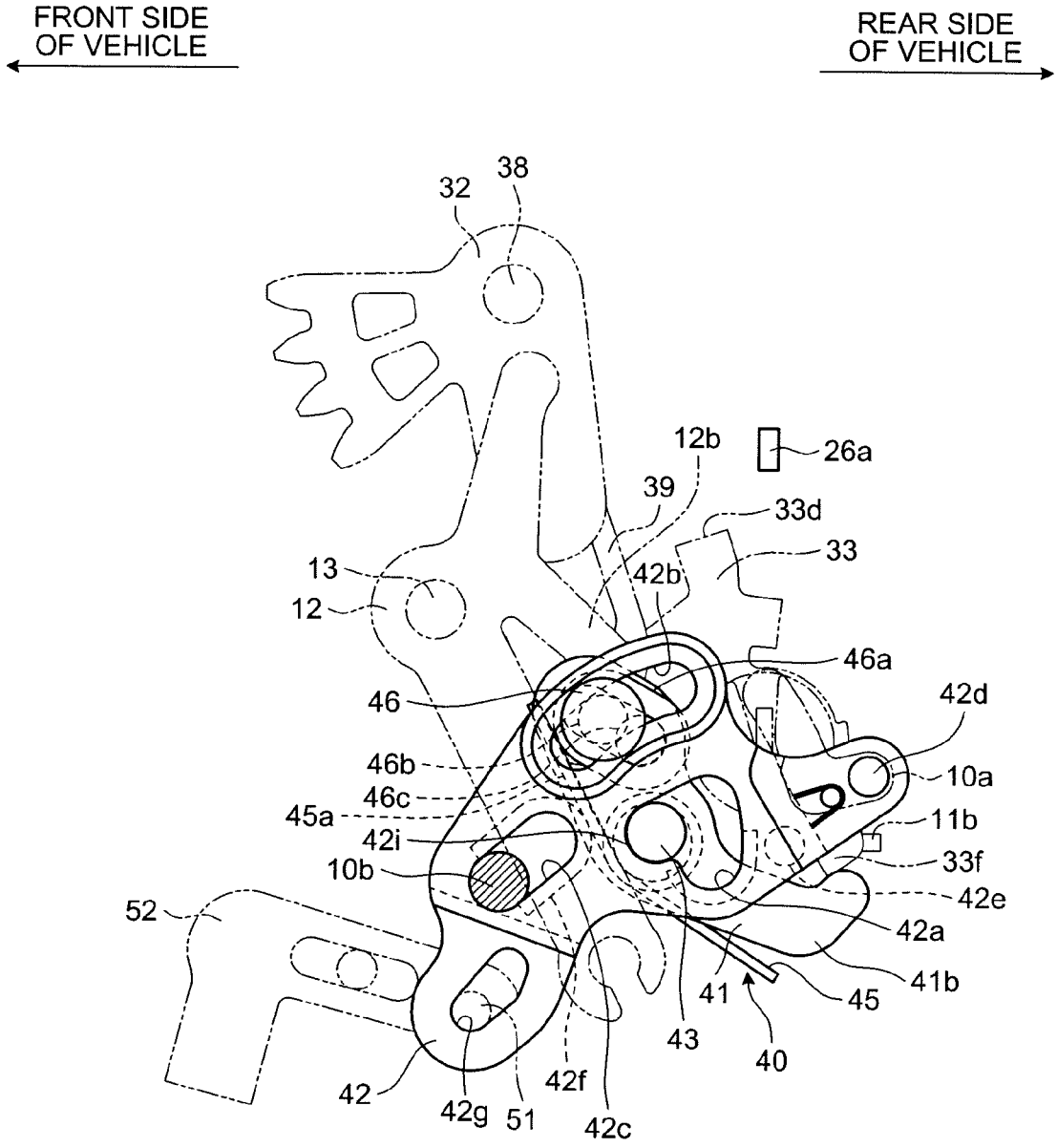
FIG. 18 is an enlarged view of main parts of the vehicle door lock device in FIG. 3.

Moreover, when the manually operated portion 42*d* is further moved from the second position shown in FIGS. 2 and 17 to the third position, i.e., towards the rear side of the vehicle body B by opposing the biasing restoring force of the restoring spring 45 (see FIGS. 3 and 18), the child-lock lever 42 moves further to the rear side such that the connect lever shaft 43 is positioned at the emergency lock portion 42*i*. In that case, the non-transmitting state of the child-lock mechanism 40 is maintained. Because the transmitting pin 46*c* is maintained outside the pivoting area of the inside-handle lock linkage portion 12*b*, the transmitting pin 46*c* does not abut against the inside-handle lock linkage portion 12*b* and the connect lever 41 does not pivot even if an attempt is made to open the door D by using the inside door handle IDH. That is, irrespective of the locked state or the unlocked state of the locking mechanism 30, the door D cannot be opened by using the inside door handle IDH.

Figure 19:
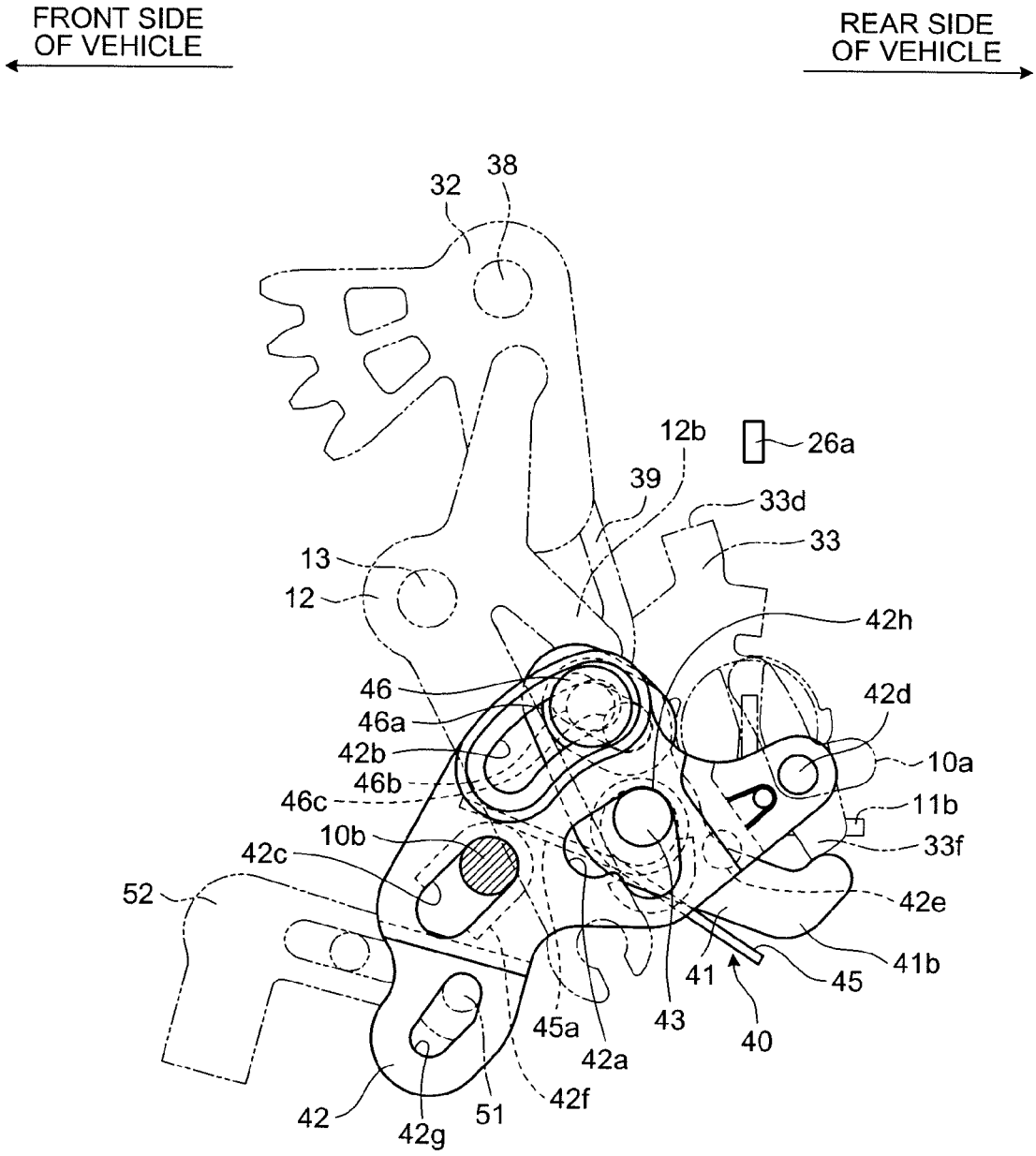
FIG. 19 is an enlarged view of main parts of the vehicle door lock device in FIG. 4.
Figure 20:
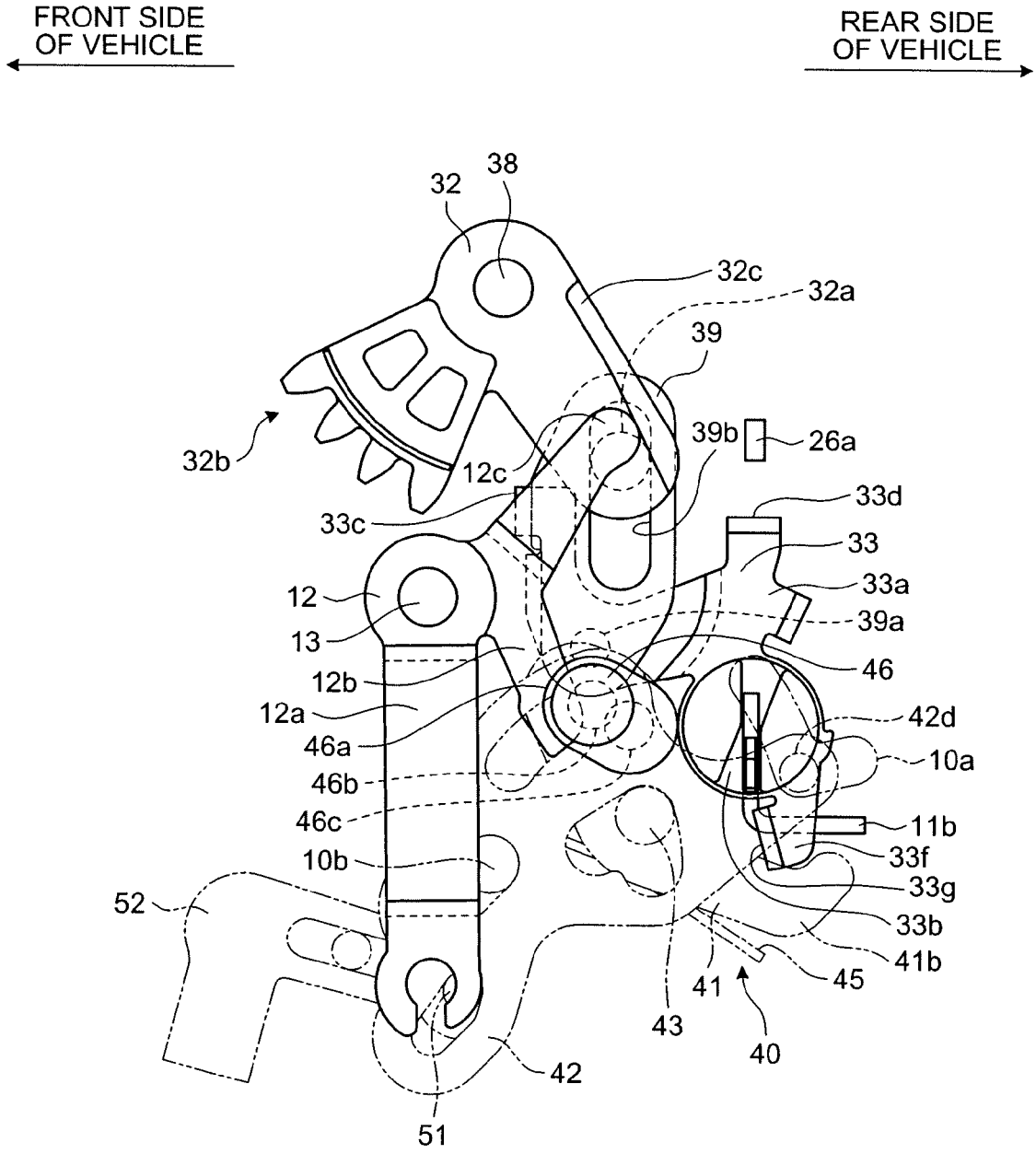
FIG. 20 is a schematic diagram for explaining a case in which the door is opened by using the inside door handle when the manually operated portion is released from the third position.

When the manually operated portion 42*d* is released from the third position, the child-lock lever 42 pivots around the connect lever shaft 43 in counterclockwise direction due to the biasing restoring force of the restoring spring 45 as shown in FIGS. 4 and 19. Consequently, the connect lever shaft 43 is repositioned at the child lock portion 42*h* and the manually operated portion 42*d* returns to the second position. The child-lock mechanism 40 is still maintained in the non-transmitting state.

As described above, during the non-transmitting state, the transmitting pin 46*c* is maintained outside the pivoting area of the inside-handle lock linkage portion 12*b*. Thus, even if an attempt is made to open the door D by using the inside door handle IDH, the transmitting pin 46*c* does not abut against the inside-handle lock linkage portion 12*b* and the connect lever 41 does not pivot. However, the sector lever abutting portion 12*c* moves the inside-handle-lever abutting portion 32*c* towards the rear side of the vehicle body B. Consequently, the sector lever 32 pivots in counterclockwise direction with reference to FIGS. 4 and 19 and the coupling pin 32*a* moves towards the rear side of the vehicle body B. Thus, the link lever 33 pivots in clockwise direction via the panic lever 39.

When the inside door handle IDH is released in such a case, the ratchet driving portion 33*d* is arranged vertically above the link lever hole 33*b* such that it lies adjacent to the bottom end of the ratchet abutting portion 26*a*. As a result, the locking mechanism 30 switches to the unlocked state. When an attempt is made to open the door D by using the outside door handle ODH and the link lever body 33*a* moves upwards due to the rotation of the open lever 11, the ratchet driving portion 33*d* abuts against the ratchet abutting portion 26*a* such that the ratchet abutting portion 26*a* is rotated upwards. As a result, the latching mechanism 20 is released from the latched state and the door D is opened with respect to the vehicle body B. That is, irrespective of the transmitting state or the non-transmitting state of the child-lock mechanism 40, the locking mechanism 30 can be switched to the unlocked state by using the inside door handle IDH. If the door D is opened thereafter by using the outside door handle ODH, the latching mechanism 20 is released from the latched state.

Usually, the first electric motor 35 can be used to easily switch the locking mechanism 30 between the locked state and the unlocked state.

If the first electric motor 35 does not work properly due to a failure or decrease in the charging voltage of a battery therein (not shown), the manually operated portion 42*d* can be moved from the first position to the third position via the second position. Consequently, the child-lock lever 42 pivots around the child-lock lever shaft 10*b* in clockwise direction and moves further to the rear side. As a result, the connect lever shaft 43 is positioned at the emergency lock portion 42*i*. Moreover, the link lever 33 pivots via the lock operating portion 42*e* and the locking mechanism 30 switches to the locked state. Although the child-lock lever 42 moves due to the biasing restoring force of the restoring spring 45, the locking mechanism 30 is maintained in the locked state. Thus, the vehicle can be protected from being stolen. Even if the first electric motor 35 does not work properly when a key cylinder is not provided inside the vehicle, it is possible to protect the vehicle from being stolen. Moreover, the direction of the manually operated portion 42*d* moving from the second position to the third position is perpendicular with the direction of the manually operated portion 42*d* moving from the first position to the second position. As a result, while moving the manually operated portion 42*d* from the first position to the second position, there is no possibility of an accidental movement thereof to the third position.

Moreover, if an attempt is made to open the door D by using the inside door handle IDH even when the first electric motor 35 is not working properly, the inside handle lever 12 still causes the locking mechanism 30 to switch to the unlocked state from the locked state. In other words, even if the child-lock mechanism 40 is in the non-transmitting state, the locking mechanism 30 is switched to the unlocked state when, e.g., a child in the vehicle attempts to open the door D by using the inside door handle IDH. Thus, the latching mechanism 20 can be released from the latched state when, e.g., a parent or a guardian attempts to open the door D by using the outside door handle ODH. Thus, even if a key cylinder is not provided inside the vehicle for security purpose, it is possible to open the door D by using the outside door handle ODH. For example, even if the manually operated portion 42*d* is accidently moved to the third position, the latching mechanism 20 can be released from the latched state by first using the inside door handle IDH and then using the outside door handle ODH. Moreover, when the child-lock mechanism 40 is in the transmitting state and the locking mechanism 30 is in the locked state, the link lever 33 and the panic lever 39 operate the inside handle lever 12 without transmitting the second signal to the latching mechanism 20. Thus, although the locking mechanism 30 is in the unlocked state when an attempt is made to open the door D by using the inside door handle IDH, the latching mechanism 20 can be released from the latched state only when another attempt is made to open the door D by using the inside door handle IDH. As a result, even if, e.g., a parent or a guardian forgets to switch the child-lock mechanism 40 to the non-transmitting state while leaving the vehicle, it is not possible for a child in the vehicle to immediately open the door D by operating the inside door handle IDH.

Moreover, in addition to using the manually operated portion 42*d*, the child-lock mechanism 40 can be switched from the transmitting state to the non-transmitting state by using the second electric motor 53 under usual conditions. By using the second electric motor 53, the power child-lock lever 52 moves along the longitudinal direction of the second worm 54 via the second output shaft 53*a* and the second worm 54. Consequently, the child-lock lever 42 is positioned at the second position via the power child-lock pin 51 such that the child-lock mechanism 40 switches to the non-transmitting state.

Thus, according to an aspect of the present invention, even if a key cylinder is not provided on an inner side of a door of a vehicle for security purpose, it is possible to open the door by using an outside door handle. Moreover, even if a parent or a guardian forgets to switch a child-lock mechanism to a non-transmitting state while leaving the vehicle, it is not possible for a child in the vehicle to immediately open the door by operating an inside door handle.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2007-190980, filed Jul. 23, 2007, which is incorporated herein by reference in its entirety.

What is claimed is:

1. A door lock device for a rear seat door of a vehicle, the door including an outside door handle arranged on an outer side of the door and an inside door handle arranged on an inner side of the door, the door lock device comprising:

a latching mechanism that, when the door is in a closed position, latches the door in a latched state and restricts movement of the door to an open position;

a locking mechanism that is arranged between the latching mechanism and the outside door handle inside a door lock case, and switches between a locked state and an unlocked state, the locking mechanism in the unlocked state transmitting to the latching mechanism a first force regarding an attempt to open the door by using the outside door handle and releasing the door from the latched state upon receiving the first force and allowing movement of the door to the open position, the locking mechanism in the locked state not transmitting the first force to the latching mechanism;

a door lock actuator that causes the locking mechanism to switch between the locked state and the unlocked state;

a child-lock mechanism that includes a child-lock lever and is arranged between the latching mechanism and the inside door handle, and switches between a transmitting state and a non-transmitting state, the child-lock mechanism in the transmitting state transmitting to the latching mechanism a second force regarding an attempt to open the door by using the inside door handle, the child-lock mechanism in the non-transmitting state not transmitting the second force to the latching mechanism;

an inside-door handle lever including a sector lever abutting portion that is operated to switch the locking mechanism to the unlocked state from the locked state when the inside door handle is operated by a user to cause the second force, a working end that is linked to the inside door handle, and an inside-handle lock linkage portion that abuts a child-lock pin being attached to the child-lock lever when the inside door handle is operated by the user while in the transmitting state; and a double action mechanism that, when the child-lock mechanism is in the transmitting state and the locking mechanism is in the locked state, allows the inside-door handle lever operated by the operation of the inside door handle by the user to cause the inside-handle lock linkage portion to abut the child-lock pin and the sector lever abutting portion to abut an inside-handle-lever abutting portion of a sector lever of the locking mechanism without transmitting the second force of the inside door handle to the latching mechanism, and switches the locking mechanism to the unlocked state when the second force is removed, and a link lever of the locking mechanism releases the latched state of the latching mechanism when the inside door handle is operated by the user under the unlocked state, wherein the double action mechanism, when the child-lock mechanism is in the non-transmitting state and the locking mechanism is in the locked state, allows the inside-door handle lever operated by the operation of the inside door handle by the user to cause the sector lever abutting portion to abut the inside-handle-lever abutting portion of the sector lever without transmitting the second force of the inside door handle to the latching mechanism by not abutting the inside-handle lock linkage portion to the child-lock pin, and switches the locking mechanism to the unlocked state when the second force is removed.

* * * * *